US009240646B2

(12) United States Patent
Endo et al.

(10) Patent No.: US 9,240,646 B2
(45) **Date of Patent: *Jan. 19, 2016**

(54) PRESS-FIT TYPE CONNECTOR TERMINAL

(71) Applicant: DAI-ICHI SEIKO CO., LTD., Kyoto (JP)

(72) Inventors: Takayoshi Endo, Shizuoka (JP); Takuya Takeda, Shizuoka (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/461,706

(22) Filed: Aug. 18, 2014

(65) Prior Publication Data

US 2014/0357135 A1 Dec. 4, 2014

Related U.S. Application Data

(62) Division of application No. 13/778,739, filed on Feb. 27, 2013, now Pat. No. 8,888,541.

(30) Foreign Application Priority Data

Mar. 15, 2012 (JP) ..... 2012-58817

(51) Int. Cl.

| | |
|---|---|
| ***H01R 13/42*** | (2006.01) |
| ***H01R 13/40*** | (2006.01) |
| ***H01R 13/05*** | (2006.01) |
| ***H01R 12/58*** | (2011.01) |

(52) U.S. Cl.

CPC ..... *H01R 13/40* (2013.01); *H01R 12/585* (2013.01); *H01R 13/05* (2013.01); *H01R 13/052* (2013.01); *H01R 13/057* (2013.01)

(58) Field of Classification Search

CPC ..... H01R 12/585; H01R 13/41
USPC ..... 439/82, 751, 827, 851
See application file for complete search history.

(56) References Cited

U.S. PATENT DOCUMENTS

| | | | |
|---|---|---|---|
| 4,155,321 | A | 5/1979 | Tamburro |
| 4,641,910 | A | 2/1987 | Rozmus |

(Continued)

FOREIGN PATENT DOCUMENTS

| | | |
|---|---|---|
| JP | 50-63188 | 6/1975 |
| JP | 61-129276 | 8/1986 |

(Continued)

OTHER PUBLICATIONS

European Search Report dated Jun. 21, 2013 in corresponding European Patent Application No. EP 13 15 3883.
Japanese Office Action issued Jul. 30, 2013 in Japanese Patent Application No. 2012-058817.

*Primary Examiner* — Phuong Dinh
(74) *Attorney, Agent, or Firm* — Wenderoth, Lind & Ponack, L.L.P.

(57) ABSTRACT

The press-fit type connector terminal includes a pin section having a U-shaped or quadrangular cross-section, and a contact section situated at a front end of the pin section, the contact section including a contact piece surrounding an imaginary center line parallel to a longitudinal axis of the pin section, and a slit formed at a part of the contact piece and extending substantially parallel to the imaginary center line, the connector terminal being comprised of a single bent metal plate having elasticity.

12 Claims, 44 Drawing Sheets

(56) References Cited

U.S. PATENT DOCUMENTS

| | | | | |
|---|---|---|---|---|
| 4,735,575 | A | 4/1988 | Shaffer | |
| 4,802,862 | A | 2/1989 | Seidler | |
| 4,908,942 | A | 3/1990 | Long et al. | |
| 5,653,615 | A | 8/1997 | Inaba et al. | |
| 8,888,541 | B2 * | 11/2014 | Endo et al. | 439/751 |
| 2007/0105456 | A1 | 5/2007 | Hashimoto et al. | |
| 2008/0188100 | A1 | 8/2008 | Saitoh | |
| 2008/0227315 | A1 | 9/2008 | Banno et al. | |
| 2013/0124886 | A1 | 5/2013 | Kung | |

FOREIGN PATENT DOCUMENTS

| | | |
|---|---|---|
| JP | 63-58466 | 4/1988 |
| JP | 63-91972 | 4/1988 |
| JP | 2004-134275 | 4/2004 |
| JP | 2006-210230 | 8/2006 |
| JP | 2007-157469 | 6/2007 |
| JP | 2009-21016 | 1/2009 |
| WO | 2006/077827 | 7/2006 |

* cited by examiner

PRESS-FIT TYPE CONNECTOR TERMINAL

BACKGROUND OF THE INVENTION

1. Field of the Invention

The invention relates to a press-fit type connector terminal to be inserted into an electrically conductive through-hole formed through a printed circuit board.

2. Description of the Related Art

Various press-fit type connector terminals have been suggested. For instance, they have a terminal contact section having a cross-section in a needle-eye, C-shaped, N-shaped or Σ-shaped form.

Japanese Patent Application Publication No. 2004-134275 has suggested a connection terminal including a head to which a cable is connected, and a body to be inserted into a through-hole formed through a substrate. The body is centrally formed with a hole extending in a length-wise direction thereof, and the hole is formed with a plurality of slits extending from an inner wall to an outer wall of the body. The hole is filled with electrically conductive adhesive.

Japanese Patent Application Publication No. 2007-157469 has suggested a press-fit type terminal including a press-fit section, a terminal base, and a male terminal. The press-fit section includes a contact having a shape which is readily able to make contact with a through-hole, and a compression section composed of elastic material. The compression section is inserted into an opening of the contact, and the compression section exerts an elastic force on the contact such that the contact is compressed onto the through-hole.

The International Publication WO2006/077827 has suggested a press-fit terminal including a press-fit contact section making electrical contact with an electrically conductive through-hole formed through a printed circuit board. A single underlying plating layer or a plurality of underlying plating layers is(are) formed on a surface of a base material of the press-fit contact section. On the uppermost playing layer is formed a layer composed of an alloy of Sn and a plating metal of which the uppermost playing layer is composed, and non-alloyed Sn is mixed in an outermost layer of the alloy layer.

Since the above-identified conventional press-fit type connector terminals are designed to have an outer diameter greater than an inner diameter of a through-hole formed through a printed circuit board, and have a press-fit section having low elasticity and to be inserted into a through-hole for making contact with the through-hole, a printed circuit board tends to be whitened due to a contact pressure exerted on the through-hole by the press-fit section, and a playing layer of the through-hole sometimes peels off. Since whitening of a printed circuit board means molecular destruction of components of which the board is composed, the molecular destruction induces not only degradation in electrical insulation of a printed circuit board and deterioration in a withstand voltage, but also an increase in a resistance of a circuit pattern.

SUMMARY OF THE INVENTION

In view of the above-mentioned problems in the conventional press-fit type connector terminals, it is an object of the present invention to provide a press-fit type connector terminal which is capable of reducing a force with which a press-fit type connector terminal is inserted into a through-hole formed through a printed circuit board, avoiding a contact section from being plastically deformed when a press-fit type connector terminal is inserted into a through-hole, avoiding a printed circuit board from being whitened, avoiding a plated surface of a through-hole from being degraded, and providing superior contact-reliability.

In the first aspect of the present invention, a press-fit type connector terminal including a pin section having a U-shaped or quadrangular cross-section, and a contact section situated at a front end of the pin section, the contact section including a contact piece surrounding an imaginary center line extending parallel to a longitudinal axis of the pin section, the contact piece being in the form of a barrel or a spindle, and a slit formed at a part of the contact piece and extending substantially parallel to the imaginary center line, the connector terminal being comprised of a single bent metal plate having elasticity.

In the press-fit type connector terminal in accordance with the present invention, the contact piece designed in the form of a barrel or a spindle is able to elastically enlarge or reduce a diameter thereof by virtue of the slits, ensuring that the contact piece defining the contact section can be elastically deformed to be inserted into a through-hole when the contact piece is inserted into a through-hole formed through a printed circuit board, the contact section does no longer exert an excessive compression force (contact pressure) onto an inner surface of a through-hole. Accordingly, it is possible to reduce a force with which the press-fit type connector terminal is inserted into a through-hole formed through a printed circuit board, prevent the contact section from being plastically deformed when the press-fit type connector terminal is inserted into a through-hole, prevent a printed circuit board from being whitened, and further prevent a plated surface of a through-hole from being degraded. Furthermore, since the contact piece inserted into a through-hole makes contact with an inner surface of the through-hole, keeping a force with which the contact piece enlarges a diameter thereof, by virtue of elastic force of the metal plate, there can be provided superior contact-reliability.

The press-fit type connector terminal may be designed to further include an inner shaft section situated in the contact section and continuous with at least one of the pin section and the contact piece.

By so designing the press-fit type connector terminal, it is possible to increase a strength of the press-fit type connector terminal, and ensure stable contact.

In the second aspect of the present invention, there is provided a press-fit type connector terminal including a pin section having a U-shaped or quadrangular cross-section, and a contact section situated at a front end of the pin section, the contact section including a plurality of "<"-shaped or arcuate contact pieces having a longitudinal axis extending parallel to an imaginary center line extending parallel to a longitudinal axis of the pin section, and outwardly protruding so as to surround the imaginary center line, the connector terminal being comprised of a single bent metal plate having elasticity.

In the press-fit type connector terminal in accordance with the present invention, the contact section can be entirely in the form of a barrel which is able to elastically enlarge or reduce a diameter thereof, ensuring that since a plurality of the contact pieces defining the contact section are elastically deformed to be inserted into a through-hole when the press-fit type connector terminal is inserted into a through-hole formed through a printed circuit board, the contact section does no longer exert an excessive compression force (contact pressure) onto an inner surface of a through-hole. Accordingly, it is possible to reduce a force with which the press-fit type connector terminal is inserted into a through-hole formed through a printed circuit board, prevent the contact section from being plastically deformed when the press-fit type connector terminal is inserted into a through-hole, prevent a printed circuit board from being whitened, and further prevent a plated surface of a through-hole from being degraded. Furthermore, since the contact pieces inserted into a through-hole makes contact with an inner surface of the through-hole at a plurality of points, keeping a force with which the contact piece enlarges a diameter thereof, there can be provided superior contact-reliability.

In addition, since the press-fit type connector terminal in accordance with the present invention can be formed by bending a single metal plate having elasticity, it is possible to reduce a number of parts and reduce fabrication costs. Comparing the "<"-shaped contact piece to the arcuate contact piece, the arcuate contact piece tends to have a higher yield strength, and hence, does not degrade until it deforms in a relatively much degree. Thus, the arcuate contact piece is superior to the "<"-shaped contact piece for enhancing repeatability with which the press-fit type connector terminal is inserted into and pulled out of a through-hole.

In the third aspect of the present invention, there is provided a press-fit type connector terminal including a pin section having a U-shaped or quadrangular cross-section, and an inner shaft section situated at a front end of the pin section, and a contact section including a plurality of "<"-shaped or arcuate contact pieces having a longitudinal axis extending parallel to a longitudinal axis of the inner shaft section, and outwardly protruding so as to surround the inner shaft section, the connector terminal being comprised of a single bent metal plate having elasticity.

In the press-fit type connector terminal in accordance with the present invention, similarly to the second aspect of the present invention, the contact section can be entirely in the form of a barrel which is able to elastically enlarge or reduce a diameter thereof, ensuring that since a plurality of the contact pieces defining the contact section are elastically deformed to be inserted into a through-hole when the press-fit type connector terminal is inserted into a through-hole formed through a printed circuit board, the contact section does no longer exert an excessive compression force (contact pressure) onto an inner surface of a through-hole. Accordingly, it is possible to reduce a force with which the press-fit type connector terminal is inserted into a through-hole formed through a printed circuit board, prevent the contact section from being plastically deformed when the press-fit type connector terminal is inserted into a through-hole, prevent a printed circuit board from being whitened, and further prevent a plated surface of a through-hole from being degraded. Furthermore, since the contact pieces inserted into a through-hole makes contact with an inner surface of the through-hole at a plurality of points, keeping a force with which the contact piece enlarges a diameter thereof, there can be provided superior contact-reliability.

In addition, since the contact section is designed to include a plurality of contact pieces having a longitudinal axis extending parallel to a longitudinal axis of the inner shaft section, and outwardly protruding so as to surround the inner shaft section, the inner shaft section is situated at the center of the contact pieces, ensuring stable contact.

In addition, similarly to the third aspect of the present invention, since the press-fit type connector terminal in accordance with the present invention can be formed by bending a single metal plate having elasticity, it is possible to reduce a number of parts and reduce fabrication costs.

It is preferable that the contact pieces are equally spaced away from adjacent ones.

By so designing the contact pieces, each of the contact pieces makes contact with an inner surface of a through-hole, keeping a force for enlarging a diameter thereof, and hence, the contact pieces make contact with an inner surface of a through-hole at a plurality of positions at an equal pitch, contact reliability can be enhanced.

It is preferable that the inner shaft section is formed at an outer surface thereof with a protrusion protruding towards the contact piece.

By so designing the inner shaft section, it is possible to prevent the excessive deformation of the contact pieces caused by reduction in a diameter of the contact pieces, by virtue of the protrusion, when the contact section of the press-fit type connector terminal is inserted into a through-hole formed through a printed circuit board, ensuring that repeatability with which the press-fit type connector terminal is inserted into and pulled out of a through-hole can be enhanced.

It is preferable that the press-fit type connector terminal further includes C-shaped binders arranged around distal and proximal ends of the contact piece so as to surround the imaginary center line.

By designing the press-fit type connector terminal to further include the C-shaped binders, it is possible to stably arrange a plurality of the contact pieces, ensuring that contact reliability can be enhanced.

It is preferable that the press-fit type connector terminal further includes a tapered inclining section at a distal end of the binder situated at a distal end of the contact piece.

By designing the press-fit type connector terminal to further include the tapered inclining section, since the tapered inclining section continuous to a distal end of the binder makes contact with an inner surface of a through-hole at an opening of the through-hole, and then, is guided into the through-hole when the contact section of the press-fit type connector terminal is inserted into a through-hole formed through a printed circuit board, ensuring insertability of the contact section can be enhanced.

It is preferable that the press-fit type connector terminal further includes a shoulder having a portion protruding beyond an outer surface of the pin section, or a flange having a portion having a diameter greater than an outer diameter of the pin section.

By designing the press-fit type connector terminal to further include the shoulder or the flange, since it is possible to exert a compression force on the shoulder having a portion protruding beyond an outer surface of the pin section, or the flange having a portion having a diameter greater than an outer diameter of the pin section in order to insert the contact section into a through-hole formed through a printed circuit board, ensuring that workability with which the contact section is inserted into a through-hole formed through a printed circuit board can be enhanced.

It is preferable that the metal plate includes a band-shaped first area for forming the pin section, a band-shaped second area for forming the inner shaft section, the second area being continuous to a distal end of the first area and having a width smaller than the same of the first area, a connection area continuous to a distal end of the second area and having a width smaller than the same of the second area, and a third area for forming the contact section, the third area including a plurality of slits extending parallel to a longitudinal axis of the second area, the third area being continuous to a distal end of the connection area and being in the substantially rectangular form having a width greater than the same of the second area.

By so designing the metal plate, it is possible to form the press-fit type connector terminal by folding the first area and the second area around the connection area longitudinally continuous to the first and second areas, folding the third area by 180 degrees towards the second area around the connection area, and bending the third area such that the third area surrounds the second area, ensuring that a fabrication yield can be enhanced.

The metal plate may be designed to include a band-shaped first area for forming the pin section, a band-shaped second area for forming the inner shaft section, the second area being continuous to a distal end of the first area and having a width smaller than the same of the first area, and a third area for forming the contact section, the third area including a plurality of slits extending parallel to a longitudinal axis of the second area, the third area being continuous to a distal end of the second area and being in the substantially rectangular form having a width greater than the same of the second area.

The metal plate may be designed to include a band-shaped first area for forming the pin section, a third area for forming the contact section, the third area including a plurality of slits extending parallel to a longitudinal axis of the first area, the third area being continuous to a distal end of the first area and being in the substantially rectangular form having a width greater than the same of the first area, and a band-shaped second area for forming the inner shaft section, the second area being continuous to a distal end of the third area and having a width smaller than the same of the third area.

It is preferable that at least a portion of the first area has a thickness greater than a thickness of the third area.

By so designing the first area, it is possible to accomplish an optimal contact load regardless of a thickness of the first and third areas.

It is preferable that the second area includes a fourth area for forming a protrusion protruding both in width-wise and thickness-wise directions of the second area.

By designing the second area to include the fourth area, a protrusion protruding towards the contact pieces can be readily formed on an outer surface of the inner shaft section.

The metal plate may be designed to include a band-shaped first area for forming the pin section, and a third area for forming the contact section, the third area including a plurality of slits extending parallel to a longitudinal axis of the first area, the third area being continuous to a distal end of the first area and being in the substantially rectangular form having a width greater than the same of the first area.

By so designing the metal plate, it is possible to readily form the press-fit type connector terminal having the pin section and the contact section, but not having the inner shaft section. Furthermore, since it is not necessary to form the second area for forming the inner shaft section, it is possible to reduce a volume of the metal plate and lighten the press-fit type connector terminal.

The metal plate may be designed to include a band-shaped first area for forming the pin section, and a third area for forming the contact section, the third area being continuous to a distal end of the first area and being in the substantially rectangular form having a width greater than the same of the first area.

By so designing the metal plate, it is possible to readily form the press-fit type connector terminal having the contact pieces in the form of a barrel or a spindle, and the slits formed at the contact pieces, but not having the inner shaft section.

The press-fit type connector terminal may be designed to further include a band-shaped second area for forming the inner shaft section, the second area being situated continuous to a distal end of the third area or between the first area and the third area, the second area having a width smaller than the same of the third area.

By so designing the press-fit type connector terminal, the press-fit type connector terminal having the inner shaft section within the contact pieces which are in the form of a barrel or a spindle can be readily formed.

The advantages obtained by the aforementioned present invention will be described hereinbelow.

The present invention provides the press-fit type connector terminal which is capable of reducing a force with which the press-fit type connector terminal is inserted into a through-hole formed through a printed circuit board, avoiding the contact section from being plastically deformed when the press-fit type connector terminal is inserted into a through-hole, avoiding a printed circuit board from being whitened, avoiding a plated surface of a through-hole from being degraded, and providing superior contact reliability.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 6:
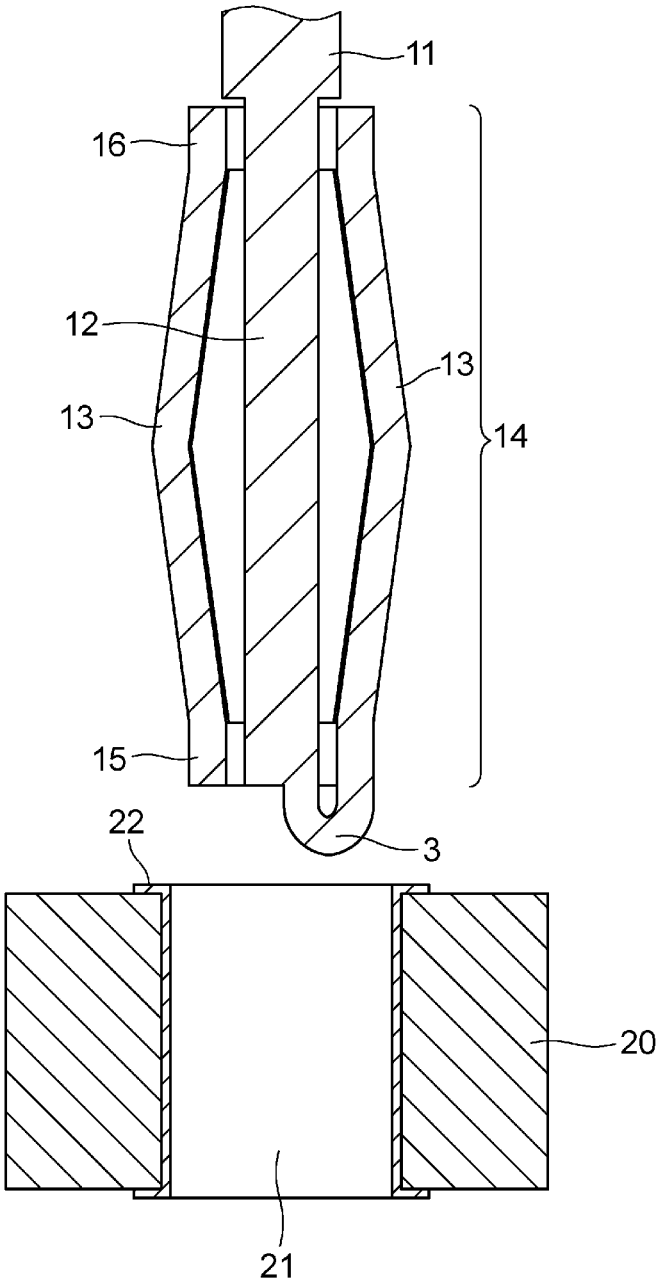
FIG. 6 is a partial cross-sectional view showing the press-fit type connector terminal illustrated in FIG. 1, immediately before inserted into a through-hole formed through a printed circuit board.
Figure 7:
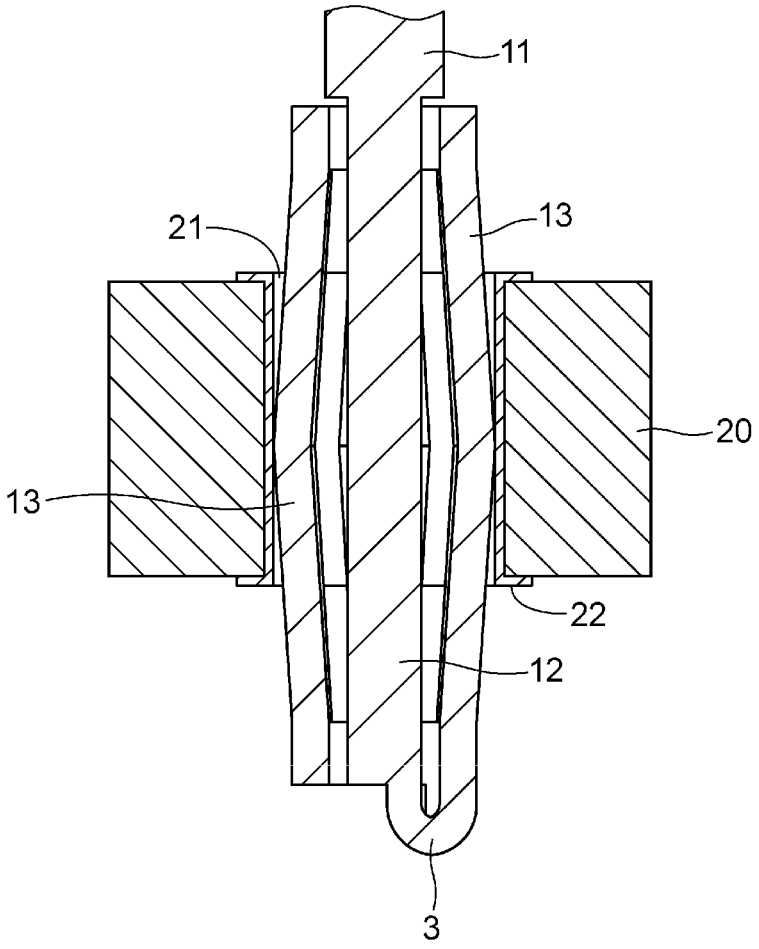
FIG. 7 is a partial cross-sectional view showing the press-fit type connector terminal illustrated in FIG. 1, after inserted into a through-hole formed through a printed circuit board.
Figure 8:
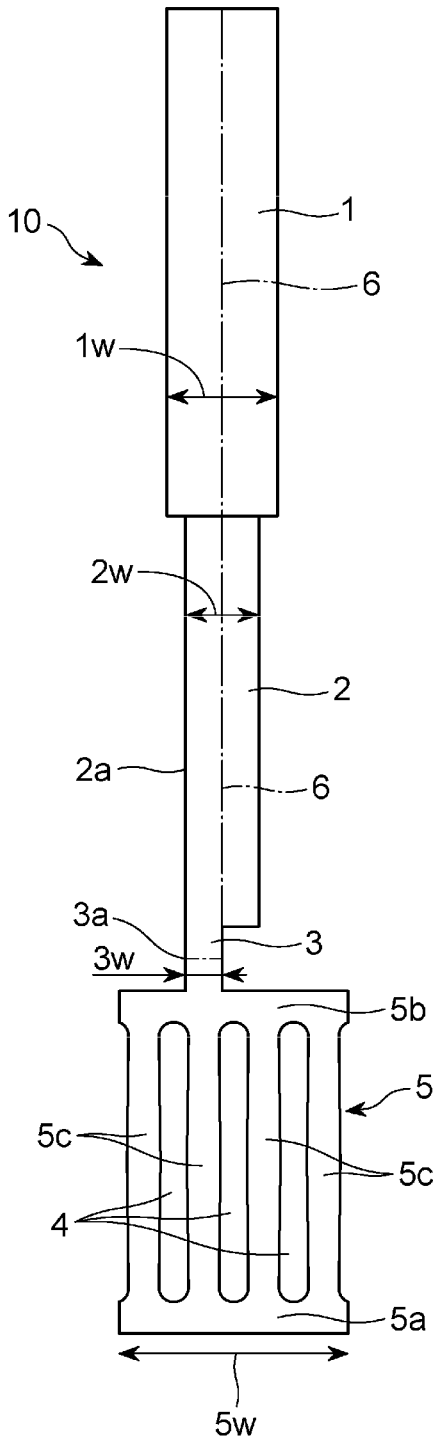
FIG. 8 is a view illustrating a developed metal plate from which the press-fit type connector terminal illustrated in FIG. 1 is fabricated.

As illustrated in FIGS. 1 to 8, the press-fit type connector terminal 100 in accordance with the first embodiment of the present invention is formed by bending a single metal plate 8 having elasticity, illustrated in FIG. 8.

The press-fit type connector terminal 100 includes a pin section 11 having a U-shaped cross-section, an inner shaft section 12 continuous to a front end of the pin section 11, and a contact section 14 including a plurality of "<"-shaped contact pieces 13 extending parallel to a longitudinal axis of the inner shaft section 12, outwardly protruding so as to surround the inner shaft section 12, and equally spaced away from adjacent ones.

Each of the contact pieces 13 defining the contact section 14 is formed at both distal and proximal ends thereof with C-shaped binders 15 and 16 surrounding the inner shaft section 12.

Figure 1:
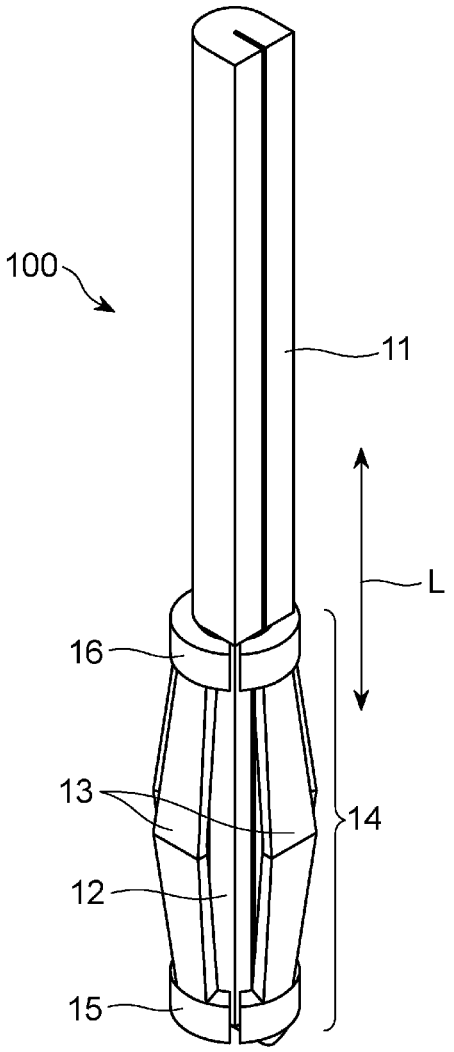
FIG. 1 is a perspective view of the press-fit type connector terminal in accordance with the first embodiment of the present invention.
Figure 2:
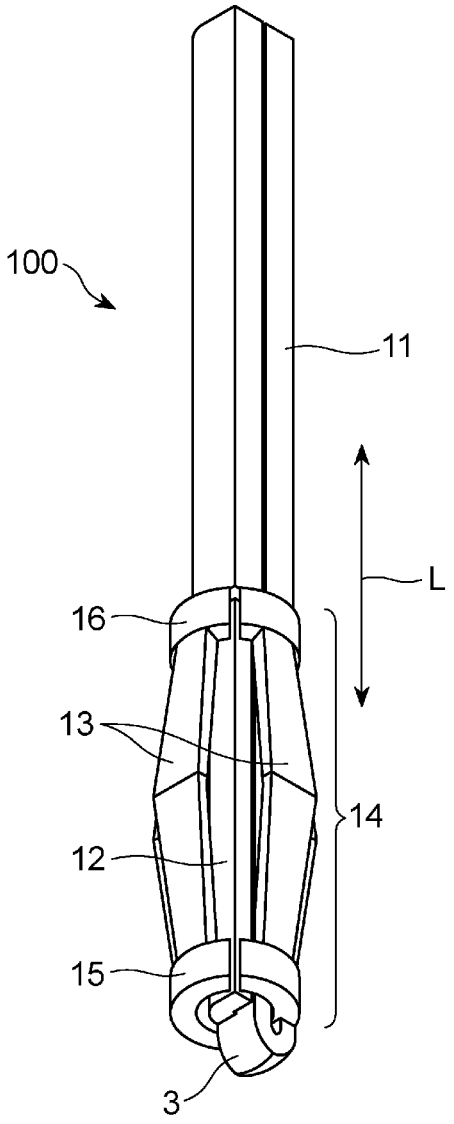
FIG. 2 is a perspective view of the press-fit type connector terminal in accordance with the first embodiment of the present invention, viewing in a different angle from FIG. 1.
Figure 3:
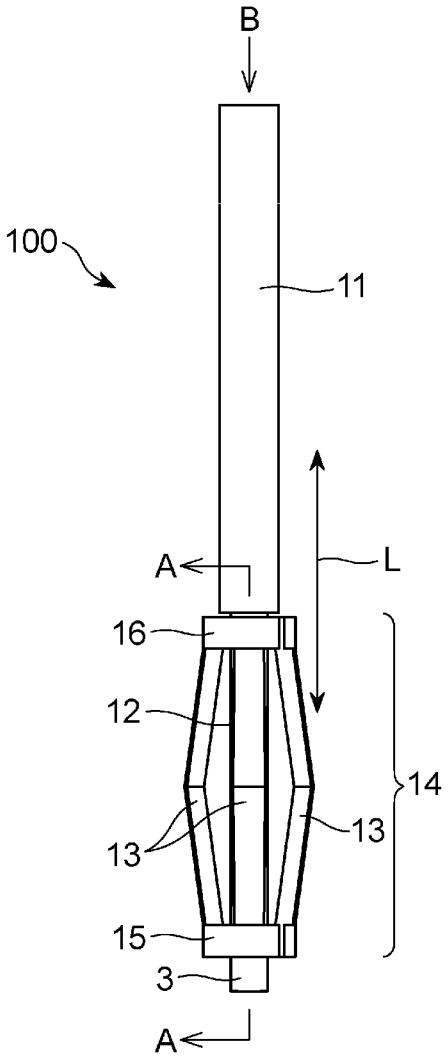
FIG. 3 is a front view of the press-fit type connector terminal illustrated in FIG. 1.
Figure 4:
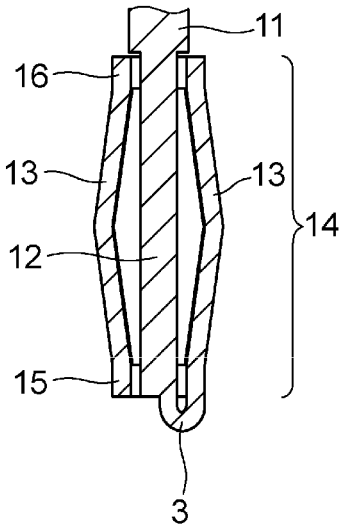
FIG. 4 is a cross-sectional view taken along the line A-A shown in FIG. 3.
Figure 5:
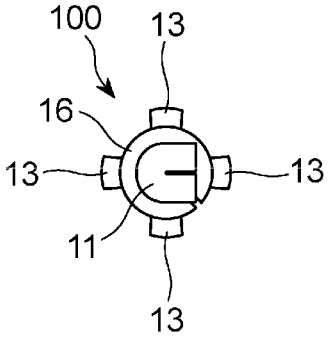
FIG. 5 is a view viewed in a direction indicated with an arrow B shown in FIG. 3.

As illustrated in FIGS. 1 to 3, the press-fit type connector terminal 100 includes the elongate bar-shaped pin section 11, the inner shaft section 12 continuous to a distal end of the pin section 11 and having a diameter smaller than the same of the pin section 11, and the contact section 14 in the form of a barrel to thereby surround the inner shaft section 12. The contact section 14 can elastically enlarge and reduce a diameter thereof.

Accordingly, as illustrated in FIGS. 6 and 7, since a plurality of the contact pieces 13 defining the contact section 14 elastically deforms such that they come close to the inner shaft section 12, and is inserted into a through-hole 21 when the contact section 14 is inserted into the through-hole 21 plated with a metal 22 and formed through a printed circuit board 20, it is possible to reduce a force with which the contact section 14 is inserted into the through-hole 21. Furthermore, since the contact section 14 does no longer exert an excessive compression force (contact pressure) onto an inner surface of the through-hole 21, a plated surface of the through-hole 21 is not degraded, and it is possible to prevent the printed circuit board 20 from being whitened. In addition, even if the pin section 11 were inclined, the contact pieces 13 would be difficult to be elastically deformed, because the contact pieces 13 make contact with the inner shaft section 12.

Furthermore, since each of the contact pieces 13 defining the contact section 14 having been inserted into the through-hole 21 equally makes contact with an inner surface of the through-hole 21 at a plurality of positions, keeping a force by which the contact pieces 13 enlarge a diameter thereof, contact defectiveness would not occur, providing superior contact reliability.

In addition, as illustrated in FIGS. 1 and 2, since C-shaped binders 15 and 16 surround the inner shaft section 12 at distal and proximal ends of each of the contact pieces 13, the contact pieces 13 can be stably arranged both when the contact section 14 is inserted into the through-hole 21 and after the contact section 14 was inserted into the through-hole 21, as illustrated in FIGS. 6 and 7, ensuring that contact reliability can be enhanced.

The press-fit type connector terminal 100 is formed by bending a single metal plate 10 having elasticity, illustrated in FIG. 8. The metal plate 10 includes a band-shaped first area 1 for forming the pin section 11, a band-shaped second area 2 continuous to a front end of the first area 1 for forming the inner shaft section 12, a connection area 3 continuous to a front end of the second area 2, and a third area 5 continuous to a front end of the connection area 3 for forming the contact section 14.

The second area 2 has a width 2w smaller than a width 1w of the first area 1. The connection area 3 has a width 3w smaller than the width 2w of the second area 2 (the width 3w is a half of the width 2w). The third area 5 has a width 5w greater than the width 2w of the second area 2. The third area 5 is formed with a plurality of slits 4 extending in parallel with a longitudinal direction L (see FIG. 3) of the second area 2. The connection area 3 has a side edge extending from a side edge 2*a* of the second area 2.

The press-fit type connector terminal 100 illustrated in FIG. 1 is formed by bending the metal plate 10 illustrated in FIG. 8 as follows.

First, both the first area 1 and the second area 2 are folded around a fold line 6 extending in a length-wise direction L of the first and second areas 1 and 2 such that the first and second areas 1 and 2 have a U-shaped cross-section. Then, the third area 5 is folded by 180 degrees towards the second area 2 around a fold line 3*a* crossing the connection area 3. Then, the third area 5 is bent such that edges 5*a* and 5*b* extending perpendicularly to the length-wise direction L are C-shaped, and pillars 5*c* of the third area 5 extending in parallel with the length-wise direction L are in the "<"-shaped form to thereby cause the third area 5 to be in the form of a barrel surrounding the inner shaft section 2.

As mentioned above, since the press-fit type connector terminal 100 can be formed by bending the single metal plate 100 having elasticity, it is possible to reduce a number of parts and reduce fabrication costs.

Second Embodiment

Hereinbelow is explained the press-fit type connector terminal 200 in accordance with the second embodiment of the present invention, with reference to FIGS. 9 to 14. The press-fit type connector terminal 200 is formed by bending a single metal plate 210 having elasticity, illustrated in FIG. 14.

The press-fit type connector terminal 200 includes a pin section 211 having a U-shaped cross-section, an inner shaft section 212 continuous to a front end of the pin section 211, and a contact section 214 including a plurality of "<"-shaped contact pieces 213 extending in parallel with a longitudinal axis of the inner shaft section 212, outwardly protruding so as to surround the inner shaft section 212, and equally spaced away from adjacent ones.

Each of the contact pieces 213 defining the contact section 214 is formed at both distal and proximal ends thereof with almost C-shaped binders 215 and 216 surrounding the inner shaft section 212. The pin section 211 is formed in the vicinity of the contact section 214 with shoulders 201 protruding beyond an outer surface of the pin section 211.

The contact section 214 has the same shape and functions as those of the contact section 14 of the press-fit type connector terminal 100 illustrated in FIG. 1. However, since the contact section 214 is designed to have the shoulders 201, it is possible to compress the shoulders 201 for inserting the contact section 214 of the press-fit type connector terminal 200 into a through-hole formed through a printed circuit board, ensuring enhanced workability.

In addition, since the press-fit type connector terminal 200 has the inner shaft section 212, it is possible to perpendicularly insert the press-fit type connector terminal 200 into a through-hole. Furthermore, even if the press-fit type connector terminal 200 were inclined when inserted into a through-hole, since the contact pieces 213 make contact with the inner shaft section 212, it is possible to prevent the press-fit type connector terminal 200 from excessively inclining, ensuring that the contact pieces 213 are not plastically deformed, and hence, can good contact condition with a through-hole.

Figure 14:
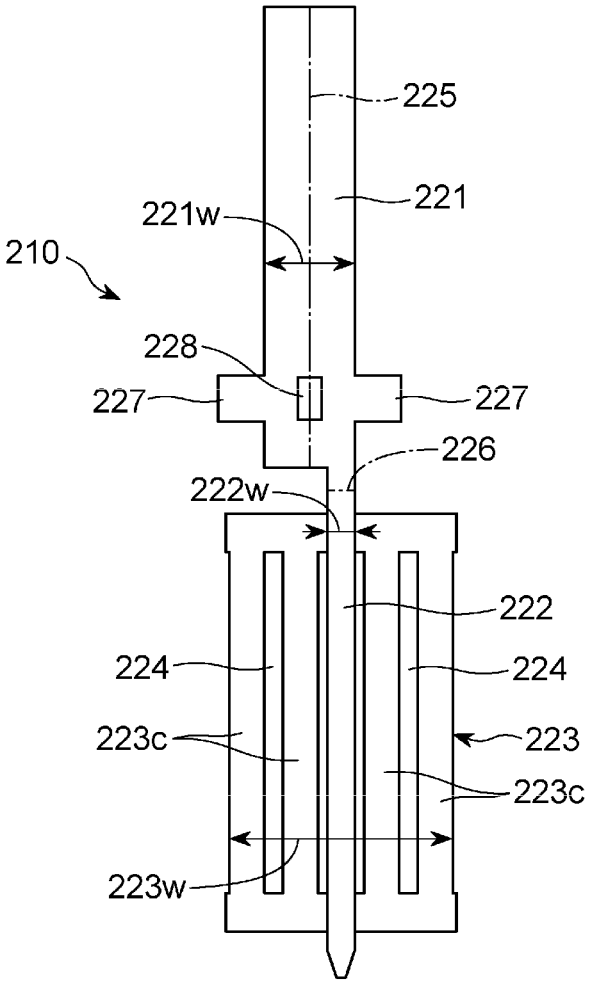
FIG. 14 is a view illustrating a developed metal plate from which the press-fit type connector terminal illustrated in FIG. 9 is fabricated.

As illustrated in FIG. 14, the metal plate 210 includes a band-shaped first area 221 for forming the pin section 211, a band-shaped second area 222 for forming the inner shaft section 212, continuous to a front end of the first area 221 and having a width 222*w* smaller than a width 221*w* of the first area 221, and a substantially rectangular third area 223 for forming the contact section 214, extending beyond the second area at opposite sides, having a width 223*w* greater than the width 222*w* of the second area 222, and having a plurality of slits 224 extending in parallel with a longitudinal axis of the second area 222. The first area 211 has protruding areas 227 and 228 for forming the shoulders 201, in the vicinity of the third area 223.

Figure 9:
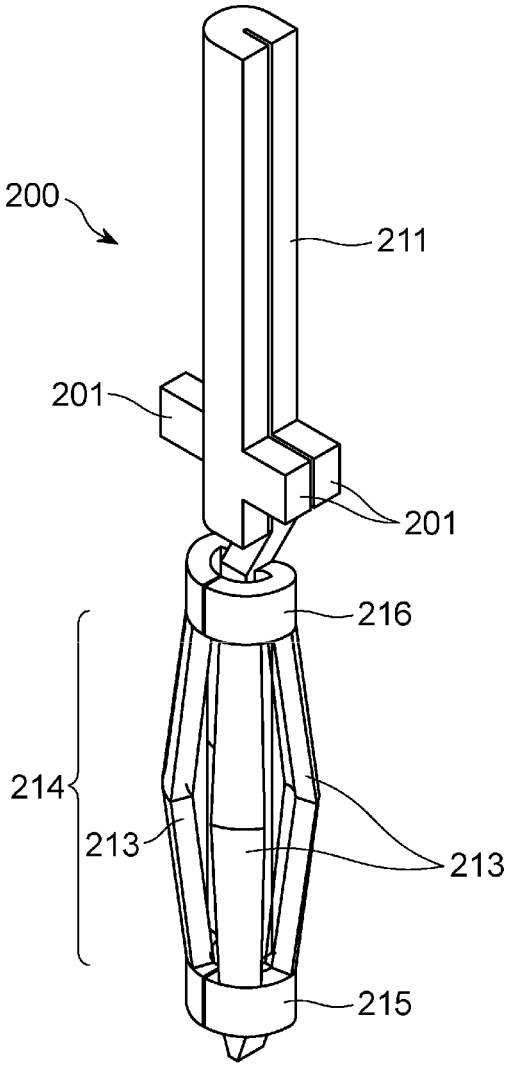
FIG. 9 is a perspective view of the press-fit type connector terminal in accordance with the second embodiment of the present invention.
Figure 10:
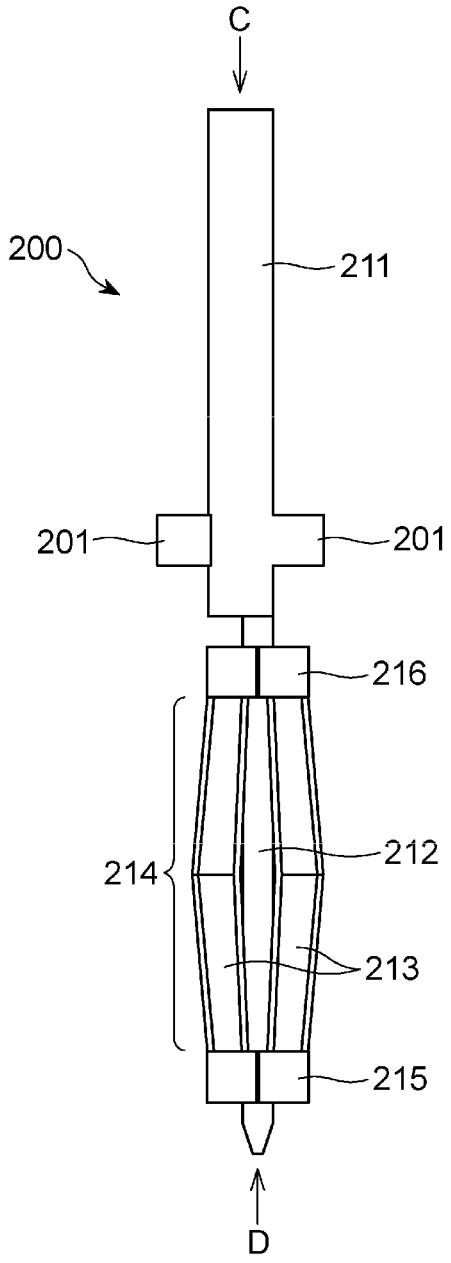
FIG. 10 is a front view of the press-fit type connector terminal illustrated in FIG. 9.
Figure 11:
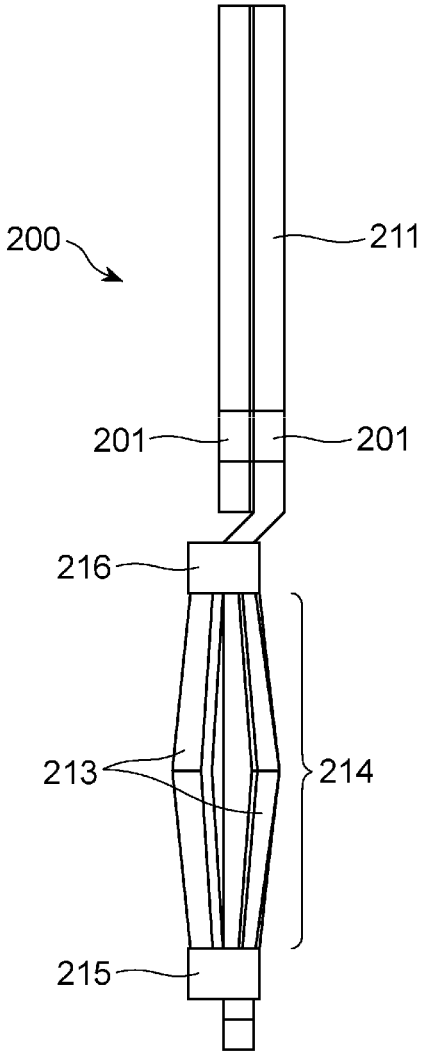
FIG. 11 is a right-side view of the press-fit type connector terminal illustrated in FIG. 9.
Figure 12:
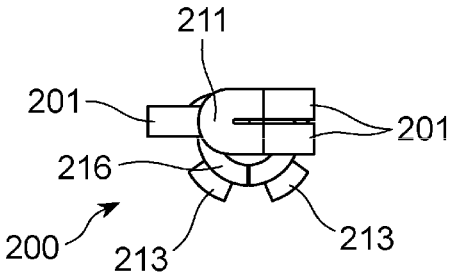
FIG. 12 is a view viewed in accordance with an arrow C shown in FIG. 10.
Figure 13:
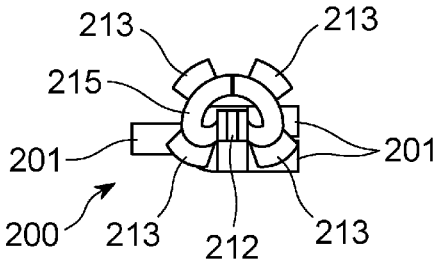
FIG. 13 is a view viewed in accordance with an arrow D shown in FIG. 10.

The press-fit type connector terminal 200 illustrated in FIG. 9 is formed by pressing the metal plate 210 having a shape illustrated in FIG. 14, as follows.

First, the first area 221 is folded around a fold line 225 extending in a length-wise direction of the first area 221 such that the first area 221 has a U-shaped cross-section. Then, a connection section 226 situated at a boundary between the first area 221 and the second area 222 is stepped. Then, the third area 223 is bent such that pillars 223*c* of the third area 223 are in the "<"-shaped form to thereby cause the third area 223 to be in the form of a barrel surrounding the inner shaft section 222.

By fabricating the press-fit type connector terminal 200 through the use of the metal plate 210 having a shape illustrated in FIG. 14, it is possible to perpendicularly insert the press-fit type connector terminal 200 into a through-hole, prevent a through-hole from being whitened, prevent a plated surface of a through-hole from being degraded, and enhancing reliability of the contact section 214.

Third Embodiment

Hereinbelow is explained the press-fit type connector terminal 300 in accordance with the third embodiment of the present invention, with reference to FIGS. 15 to 20. The press-fit type connector terminal 300 is formed by bending a single metal plate 310 having elasticity, illustrated in FIG. 20.

The press-fit type connector terminal 300 includes a pin section 311 having a U-shaped cross-section, an inner shaft section 312 continuous to a front end of the pin section 311, and a contact section 314 including a plurality of "<"-shaped contact pieces 313 extending in parallel with a longitudinal axis of the inner shaft section 312, outwardly protruding so as to surround the inner shaft section 312, and equally spaced away from adjacent ones.

Each of the contact pieces 313 defining the contact section 314 is formed at both distal and proximal ends thereof with C-shaped binders 315 and 316 surrounding the inner shaft section 312. The pin section 311 is formed in the vicinity of the contact section 314 with a flange 301 having a diameter greater than an outer diameter of the pin section 311.

The contact section 314 has the same shape and functions as those of the contact section 14 of the press-fit type connector terminal 100 illustrated in FIG. 1. However, since the contact section 314 is designed to have the flange 301, it is possible to compress the flange 301 for inserting the contact section 314 of the press-fit type connector terminal 300 into a through-hole formed through a printed circuit board, ensuring enhanced workability.

Figure 19:
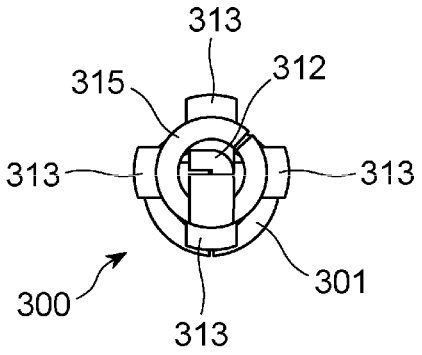
FIG. 19 is a view viewed in accordance with an arrow F shown in FIG. 16.

In addition, since the press-fit type connector terminal 300 has the inner shaft section 312 illustrated in FIG. 19, it is possible to perpendicularly insert the press-fit type connector terminal 300 into a through-hole. Furthermore, even if the press-fit type connector terminal 300 were inclined when inserted into a through-hole, since the contact pieces 313 make contact with the inner shaft section 312, it is possible to prevent the press-fit type connector terminal 300 from excessively inclining, ensuring that the contact pieces 313 are not plastically deformed, and hence, can good contact condition with a through-hole.

Figure 20:
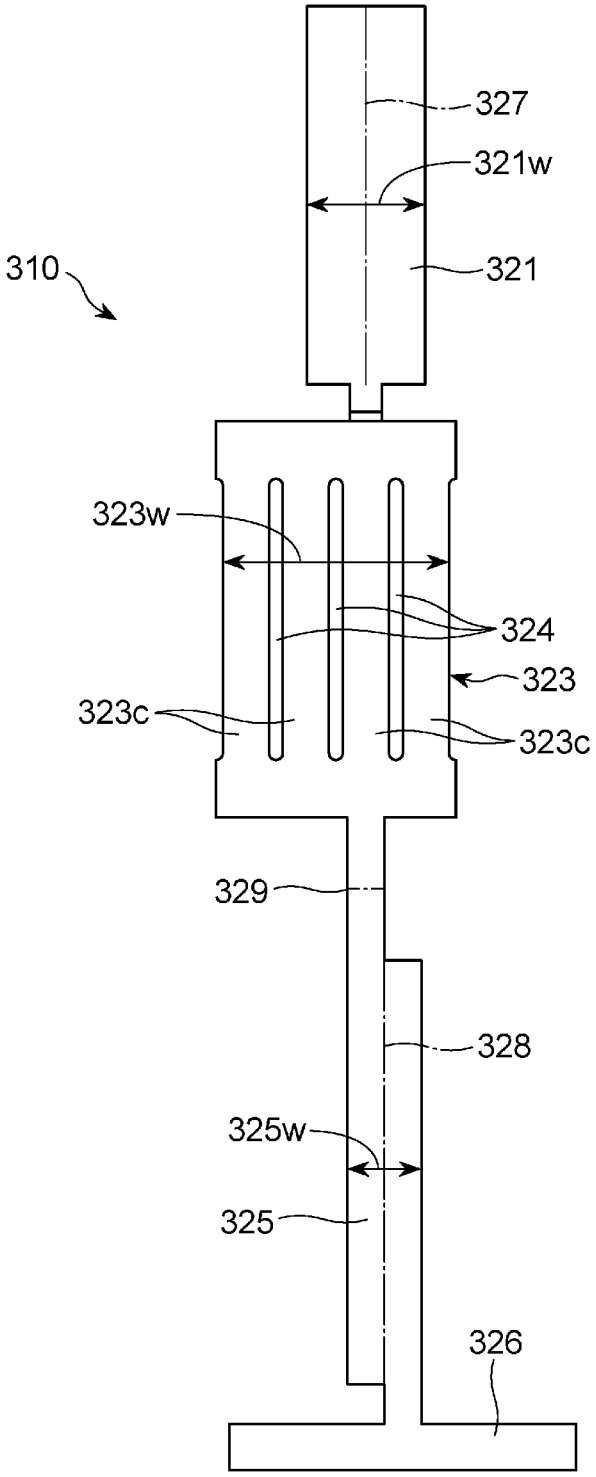
FIG. 20 is a view illustrating a developed metal plate from which the press-fit type connector terminal illustrated in FIG. 15 is fabricated.

As illustrated in FIG. 20, the metal plate 310 includes a band-shaped first area 321 for forming the pin section 311, a substantially rectangular third area 323 for forming the contact section 314, continuous to a front end of the first area 321, having a width 323*w* greater than a width 321*w* of the first area 321, and having a plurality of slits 324 extending in parallel with a longitudinal axis of the first area 321, and a band-shaped second area 325 for forming the inner shaft section 312, continuous to a front end of the third area 323, and having a width 325*w* smaller than the width 323*w* of the third area 323. The metal plate 310 further includes a fourth area 326 for forming the flange 301, continuous to the second area 325, and intersecting in T-shape with the second area 325.

Figure 15:
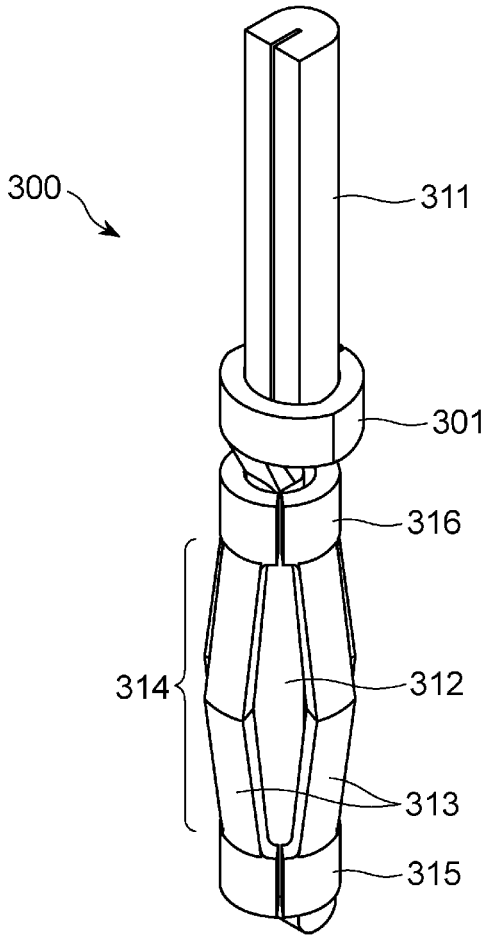
FIG. 15 is a perspective view of the press-fit type connector terminal in accordance with the third embodiment of the present invention.
Figure 16:
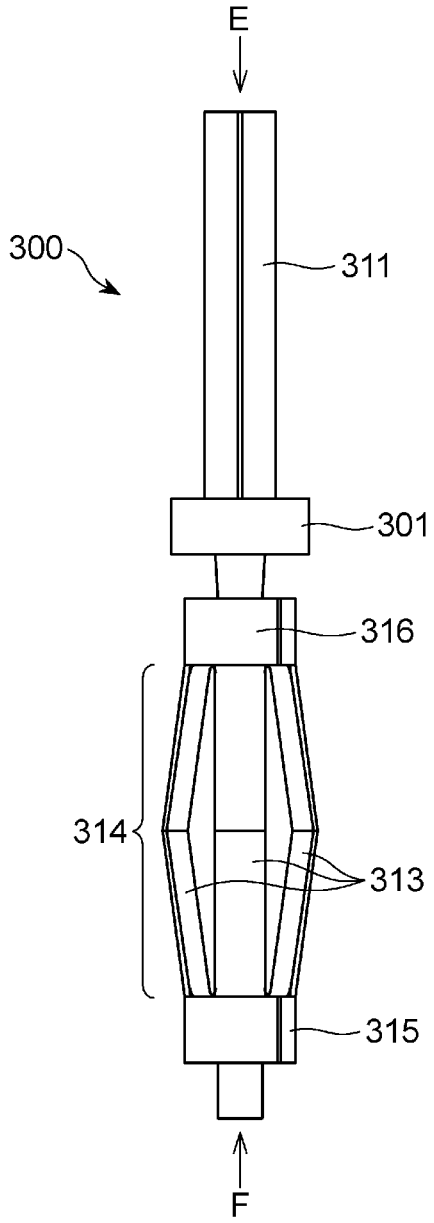
FIG. 16 is a front view of the press-fit type connector terminal illustrated in FIG. 15.
Figure 17:
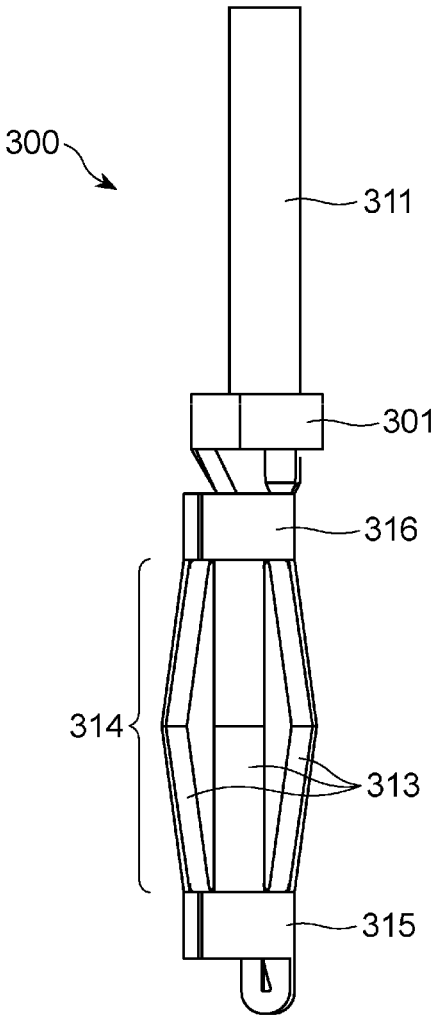
FIG. 17 is a right-side view of the press-fit type connector terminal illustrated in FIG. 15.
Figure 18:
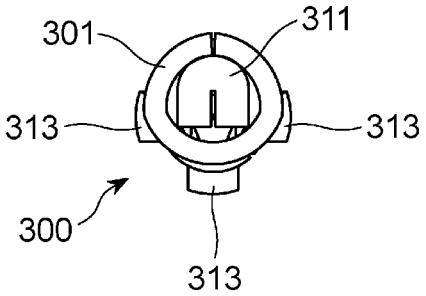
FIG. 18 is a view viewed in accordance with an arrow E shown in FIG. 16.

The press-fit type connector terminal 300 illustrated in FIG. 15 is formed by pressing the metal plate 310 having a shape illustrated in FIG. 20, as follows.

First, the first area 321 and the second area 325 are folded around fold lines 327 and 328 extending in a length-wise direction of the first and second areas 321 and 325, respectively, such that the first and second areas 321 and 325 have a U-shaped cross-section. Then, the metal plate 310 is folded by 180 degrees around a fold line 329, and the fourth area 326 is bent in the form of a ring so as to surround the pin section 311. Thereafter, the third area 323 is bent such that pillars 323*c* of the third area 323 are in the "<"-shaped form to thereby cause the third area 323 to be in the form of a barrel surrounding the inner shaft section 312.

By fabricating the press-fit type connector terminal 300 through the use of the metal plate 310 having a shape illustrated in FIG. 20, it is possible to perpendicularly insert the press-fit type connector terminal 300 into a through-hole, prevent a through-hole from being whitened, prevent a plated surface of a through-hole from being degraded, and enhancing reliability of the contact section 314.

Fourth Embodiment

Hereinbelow is explained the press-fit type connector terminal 400 in accordance with the fourth embodiment of the present invention, with reference to FIGS. 21 to 26. The press-fit type connector terminal 400 is formed by bending a single metal plate 410 having elasticity, illustrated in FIG. 26.

The press-fit type connector terminal 400 includes a pin section 411 having a quadrangular cross-section, an inner shaft section 412 continuous to a front end of the pin section 411, and a contact section 414 including a plurality of "<"-shaped contact pieces 413 extending in parallel with a longitudinal axis of the inner shaft section 412, outwardly protruding so as to surround the inner shaft section 412, and equally spaced away from adjacent ones.

Each of the contact pieces 413 defining the contact section 414 is formed at both distal and proximal ends thereof with C-shaped binders 415 and 416 surrounding the square-pole shaped inner shaft section 412. The pin section 411 is formed at a center in a length-wise direction with shoulders 401 protruding beyond an outer surface of the pin section 411.

The contact section 414 has the same shape and functions as those of the contact section 14 of the press-fit type connector terminal 100 illustrated in FIG. 1. However, since the contact section 414 is designed to have the shoulders 401, it is possible to compress the shoulders 401 for inserting the contact section 414 into a through-hole formed through a printed circuit board, ensuring enhanced workability.

Since the press-fit type connector terminal 400 is designed to have the inner shaft section 412 having a quadrangular cross-section and being in the form of a square pole, it is possible to perpendicularly insert the press-fit type connector terminal 400 into a through-hole. Furthermore, even if the press-fit type connector terminal 400 were inclined when inserted into a through-hole, since the contact pieces 413 make contact with the inner shaft section 412, it is possible to prevent the press-fit type connector terminal 400 from excessively inclining, ensuring that the contact pieces 413 are not plastically deformed, and hence, can good contact condition with a through-hole.

Figure 21:
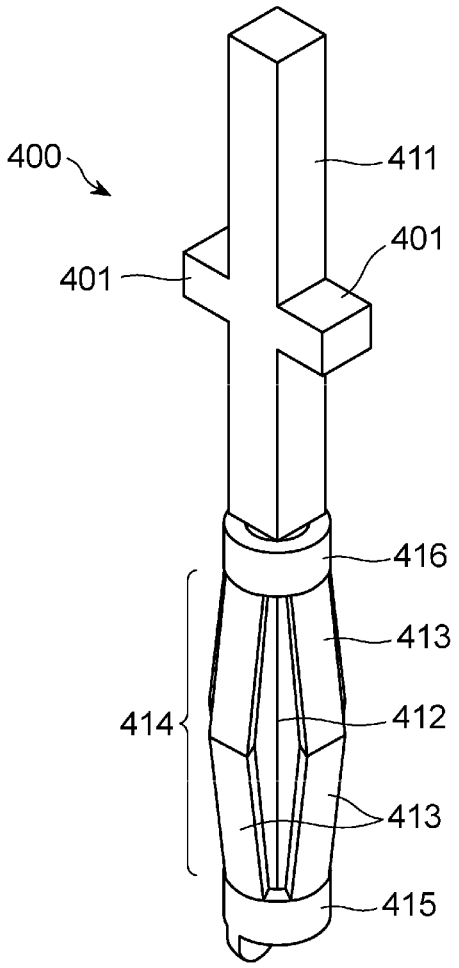
FIG. 21 is a perspective view of the press-fit type connector terminal in accordance with the fourth embodiment of the present invention.
Figure 26:
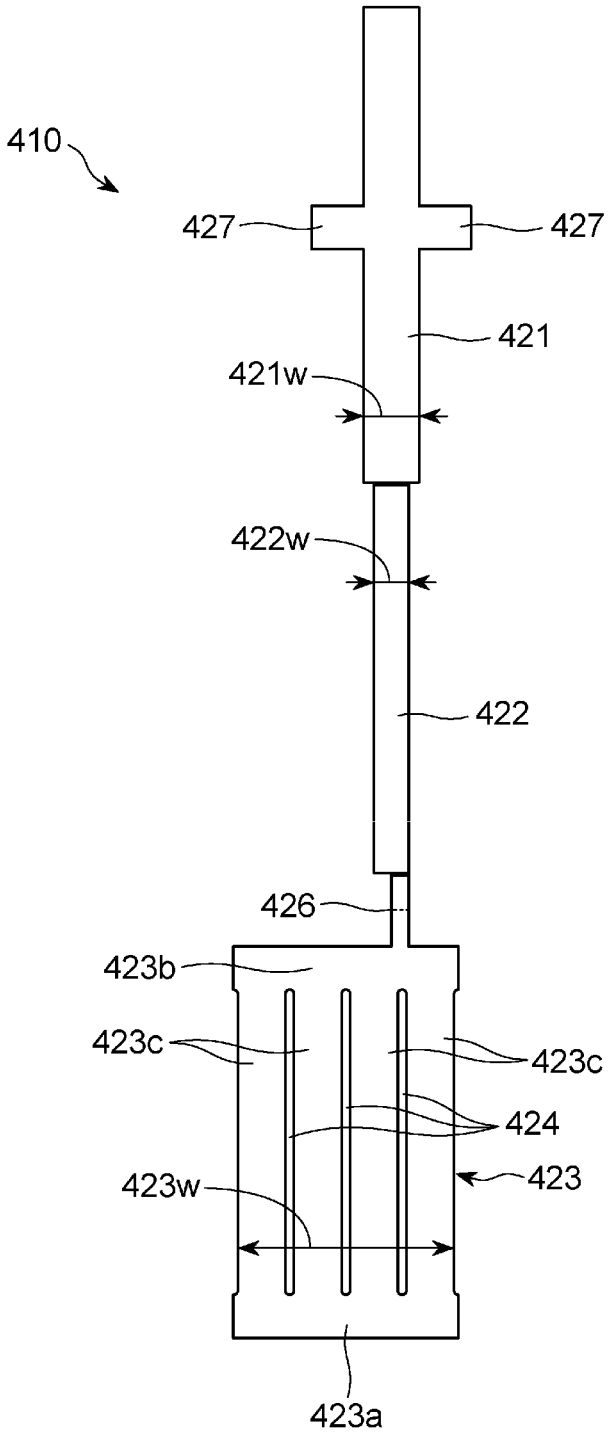
FIG. 26 is a view illustrating a developed metal plate from which the press-fit type connector terminal illustrated in FIG. 21 is fabricated.

The press-fit type connector terminal 400 illustrated in FIG. 21 is made from the metal plate 410 illustrated in FIG. 26. The metal plate 410 includes a first area 421 for forming the square-pole shaped pin section 411, a second area 422 for forming the square-pole shaped inner shaft section 412, continuous to a front end of the first area 421, a third area 423 for forming the contact section 414, continuous to a front end of the second area 422. The second area 422 has a width 422*w* smaller than a width 421*w* of the first area 421. The third area 423 is substantially rectangular, and has a width 423*w* greater than the width 422*w* of the second area 422. The third area 423 is formed with a plurality of slits 424 extending in parallel with a longitudinal axis of the second area 422.

The first area 421 includes at a center in a length-wise direction thereof a fifth area 427 for forming the shoulders 401. The first area 421 has a thickness greater than a thickness of the third area 423. The second area 422 has a thickness smaller than a thickness of the first area 421, but greater than a thickness of the third area 423. A relation among the thicknesses of the first to third areas 421, 422 and 423 can be changed by selecting a metal plate having a different shape, collapsing the first to third areas by pressing, or cutting the first to third areas.

The press-fit type connector terminal 400 illustrated in FIG. 21 is formed by pressing the metal plate 410 having a shape illustrated in FIG. 26, as follows.

First, the third area 423 is folded by 180 degrees towards the second area 422 around a fold line 426 situated at a boundary between the second area 422 and the third area 423. Then, the third area 423 is bent such that side edges 423*a* and 423*b* of the third area 423 are in the C-shaped form and that pillars 423*c* of the third area 423 are bend in the "<"-shaped form to thereby cause the third area 423 to be in the form of a barrel surrounding the inner shaft section 422 therein.

By fabricating the press-fit type connector terminal 400 through the use of the metal plate 410 having a shape illustrated in FIG. 26, it is possible to perpendicularly insert the press-fit type connector terminal 400 into a through-hole, prevent a through-hole from being whitened, prevent a plated surface of a through-hole from being degraded, and enhancing reliability of the contact section 414.

Fifth Embodiment

Hereinbelow is explained the press-fit type connector terminal 500 in accordance with the fifth embodiment of the present invention, with reference to FIGS. 27 to 35B. The press-fit type connector terminal 500 is formed by bending a single metal plate 510 having elasticity, illustrated in FIGS. 35A and 35B.

The press-fit type connector terminal 500 includes a pin section 511 having a U-shaped cross-section, an inner shaft section 512 continuous to a front end of the pin section 511, and a contact section 514 including a plurality of arcuate contact pieces 513 extending in parallel with a longitudinal axis of the inner shaft section 512, outwardly protruding so as to surround the inner shaft section 512, and equally spaced away from adjacent ones.

The inner shaft section 512 is formed at an outer surface thereof with a plurality of protrusions 501 protruding towards the contact pieces 513. Each of the contact pieces 513 is formed at both distal and proximal ends thereof with C-shaped binders 515 and 516 surrounding the inner shaft section 512. The binder 515 situated at front ends of the contact pieces 513 is designed to include at a distal end thereof a tapered inclining section 502. The pin section 511 is formed in the vicinity of the contact section 514 in a length-wise direction thereof with shoulders 503 protruding beyond an outer surface of the pin section 511.

The press-fit type connector terminal 500 is used in the same way and has the same functions as the press-fit type connector terminal 200 illustrated in FIG. 9. However, since the press-fit type connector terminal 500 is designed to have the protrusions 501 protruding towards the contact pieces 513, at an outer surface of the inner shaft section 512, it is possible to prevent, by virtue of the protrusions 501, the excessive deformation of the contact pieces 513 which is caused by the shrinkage in a diameter of the contact section 514 when the contact section 514 of the press-fit type connector terminal 500 is inserted into the through-hole 21 formed through the printed circuit board 20, as illustrated in FIG. 6. Thus, it is possible to enhance the repeatability with which the press-fit type connector terminal 500 is inserted into and pulled out of the through-hole 21.

Furthermore, since the press-fit type connector terminal 500 is designed to include the tapered inclining section 502 at a distal end of the binder 515 situated at distal ends of the contact pieces 513, when the contact section 514 of the press-fit type connector terminal 500 is inserted into the through-hole 21 (see FIG. 6) formed through the printed circuit board 20, the tapered inclining section 502 continuous to a distal end of the binder 515 makes contact with an inner surface of the through-hole 21 at an opening of the through-hole 21, and then, is guided into the through-hole 21, ensuring insertability of the contact section 54 into the through-hole 21 can be enhanced.

Each of the contact pieces 513 defining the contact section 514 in the press-fit type connector terminal 500 is designed to be arcuate. Since the arcuate contact pieces have a higher yield strength than the same of the "<"-shaped contact pieces, it is possible to prevent the contact pieces 513 from being degraded until they deform in a relatively much degree. Thus, the arcuate contact piece 513 is superior to the "<"-shaped contact piece for enhancing repeatability with which the press-fit type connector terminal 500 is inserted into and pulled out of the through-hole 21.

Figure 27:
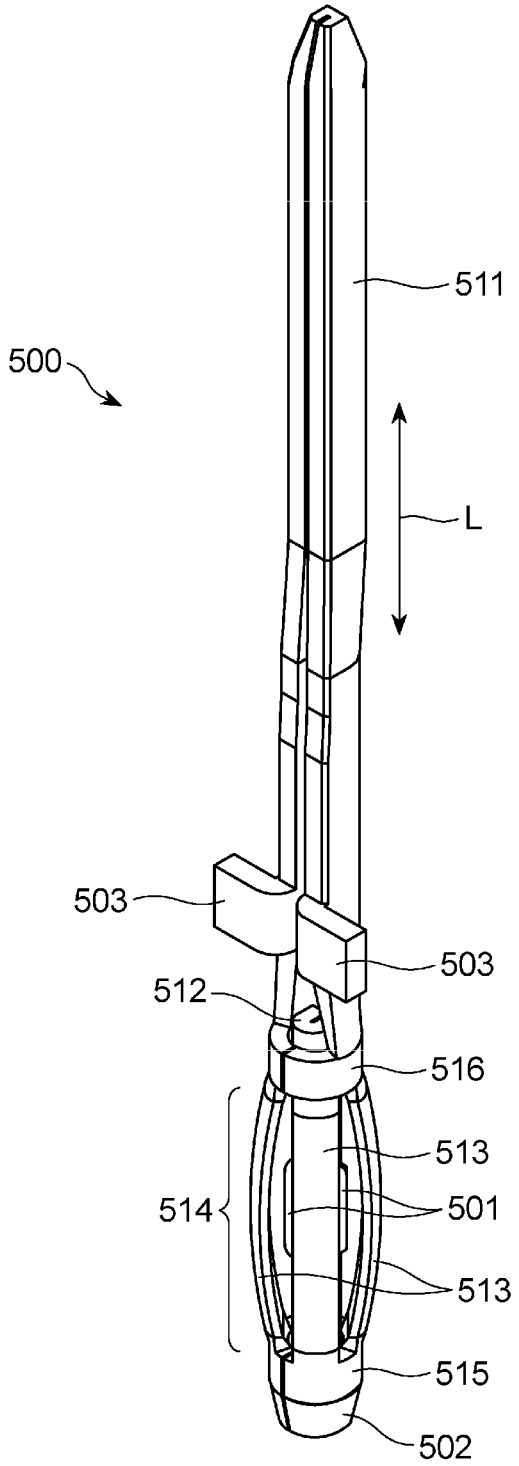
FIG. 27 is a perspective view of the press-fit type connector terminal in accordance with the fifth embodiment of the present invention.
Figure 28:
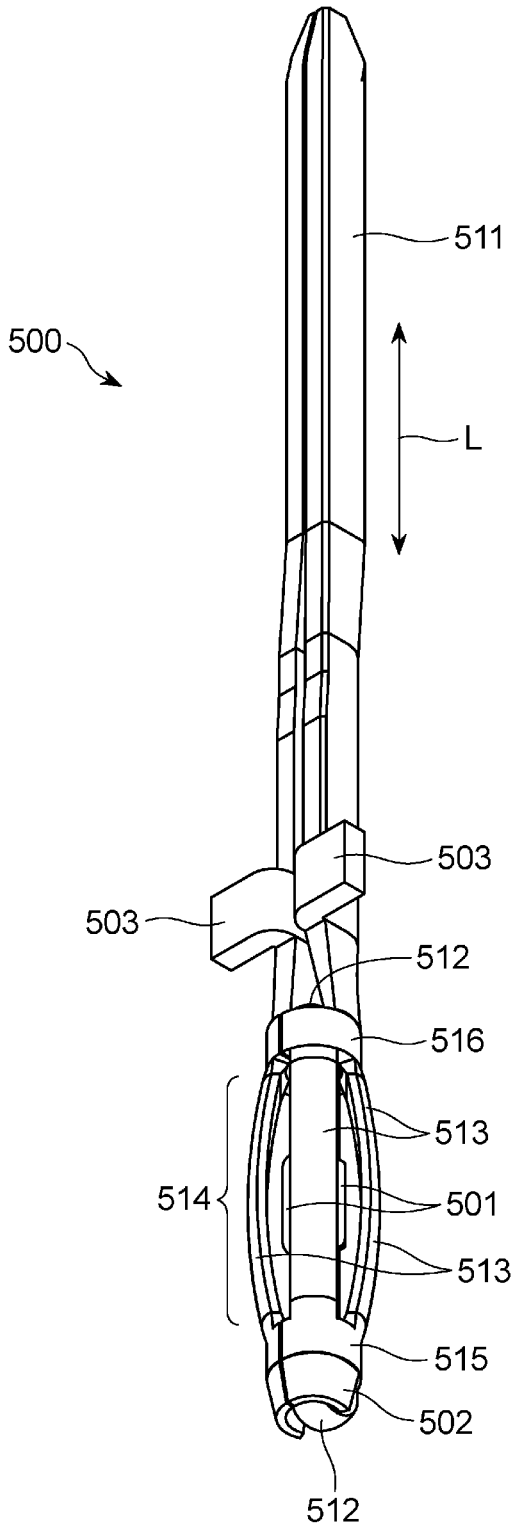
FIG. 28 is a perspective view of the press-fit type connector terminal illustrated in FIG. 27, viewing in a different angle from FIG. 27.
Figure 29:
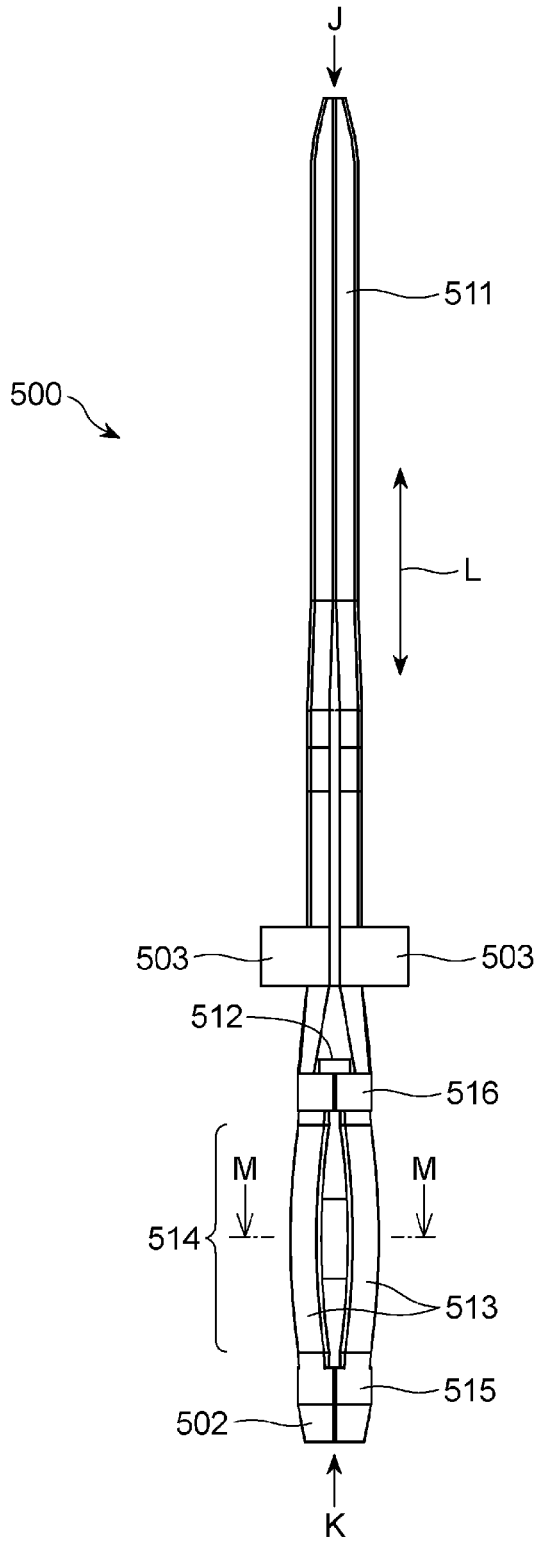
FIG. 29 is a front view of the press-fit type connector terminal illustrated in FIG. 27.
Figure 30:
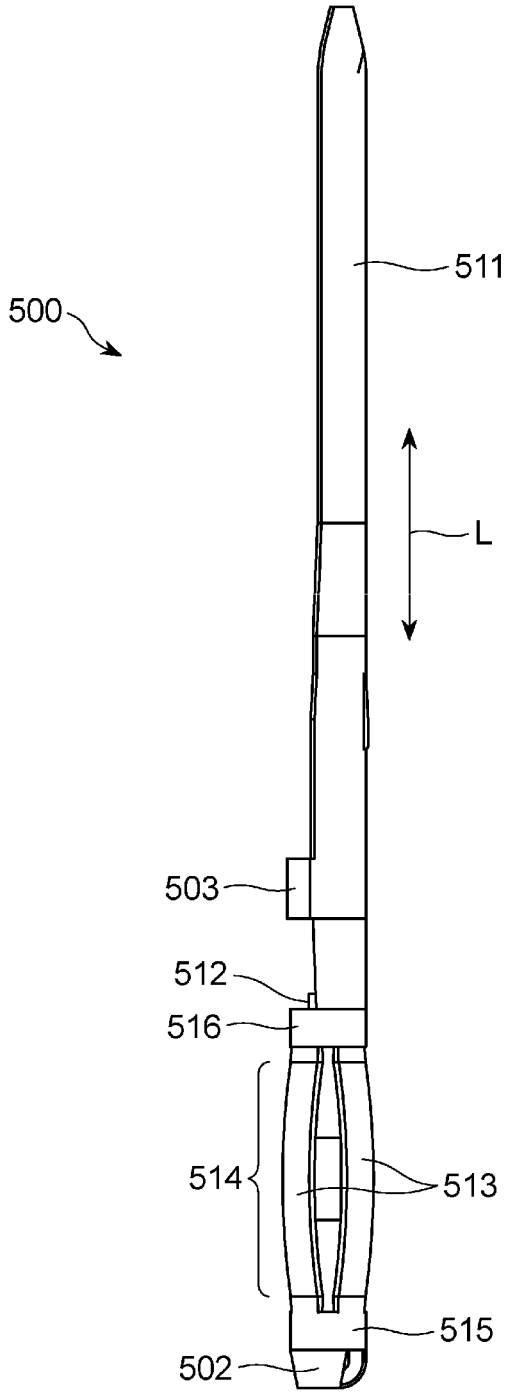
FIG. 30 is a right-side view of the press-fit type connector terminal illustrated in FIG. 29.
Figure 31:
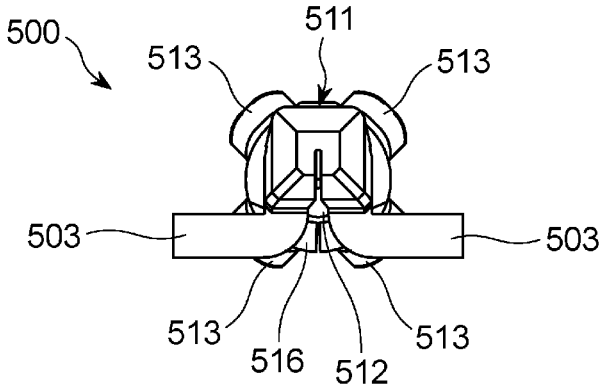
FIG. 31 is a view viewed in accordance with an arrow J shown in FIG. 29.
Figure 32:
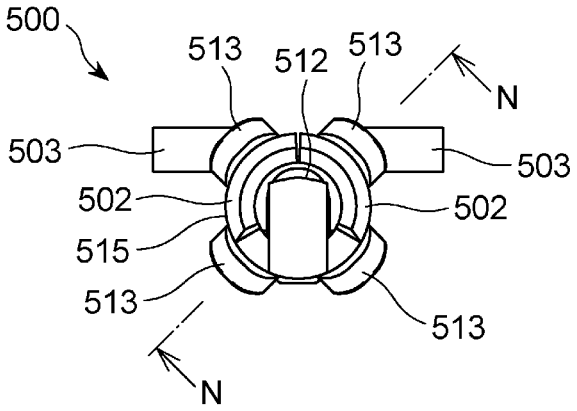
FIG. 32 is a view viewed in accordance with an arrow K shown in FIG. 29.
Figure 33:
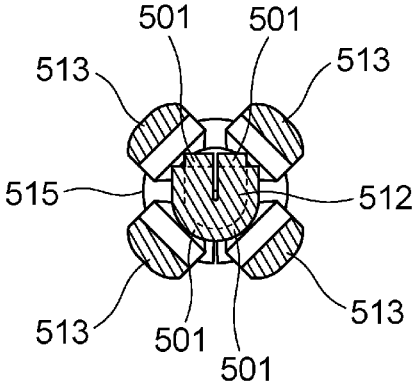
FIG. 33 is a cross-sectional view taken along the line M-M shown in FIG. 29.
Figure 34:
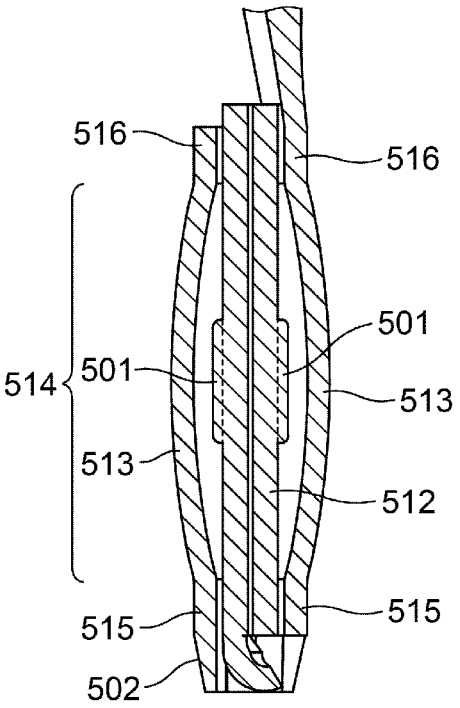
FIG. 34 is a partial cross-sectional view taken along the line N-N shown in FIG. 29.
Figure 35A:
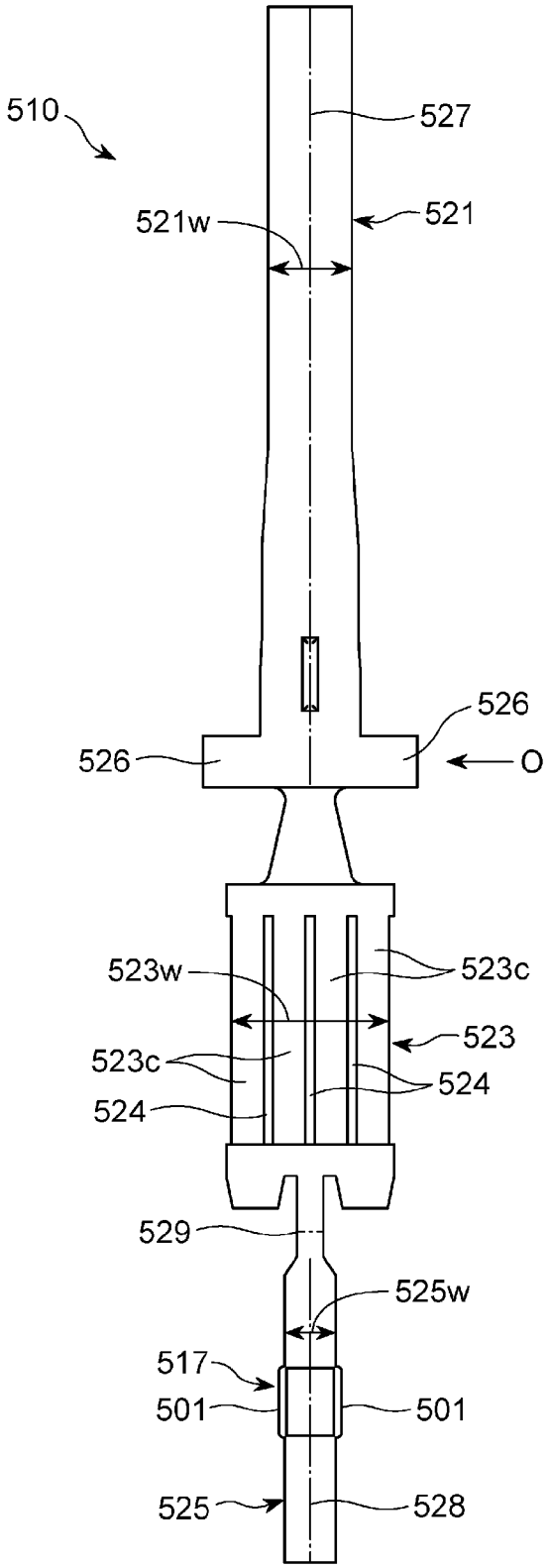
FIG. 35A is a view illustrating a developed metal plate from which the press-fit type connector terminal illustrated in FIG. 27 is fabricated.
Figure 35B:
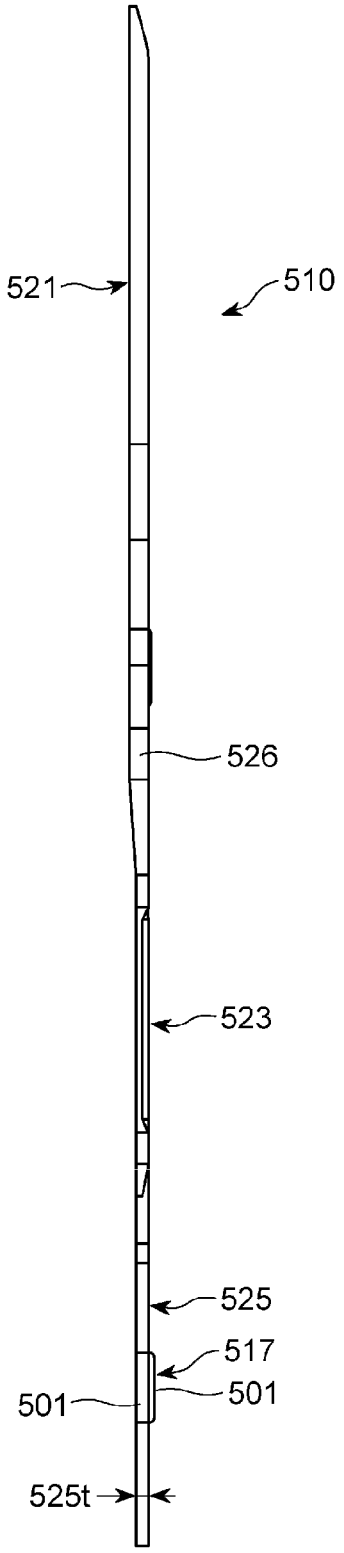
FIG. 35B is a view viewed in accordance with an arrow O shown in FIG. 35A.

The press-fit type connector terminal 500 illustrated in FIG. 27 is made from the metal plate 510 illustrated in FIGS. 35A and 35B. The metal plate 510 includes a band-shaped first area 521 for forming the pin section 511, a substantially rectangular third area 523 for forming the contact section 514, continuous to a front end of the first area 521, having a width 523*w* greater than a width 521*w* of the first area 521, and having a plurality of slits 524 and pillars 523*c* both extending in parallel with a longitudinal axis of the first area 521, and a band-shaped second area 525 for forming the inner shaft section 512, continuous to a front end of the third area 523, and having a width 525*w* smaller than the width 523*w* of the third area 523. The metal plate 510 further includes a fifth area 526 for forming the shoulders 503, continuous to the first area 521, and intersecting in T-shape with the first area 521. The second area 525 is formed at a center thereof with a fourth area 517 for forming the protrusions 501. The fourth area 517 protrudes beyond the second area 525 in both a width-wise direction 525*w* and a thickness-wise direction 525*t* of the second area 525.

The press-fit type connector terminal 500 illustrated in FIG. 27 is formed by pressing the metal plate 510 having a shape illustrated in FIGS. 35A and 35B, as follows.

First, the first area 521 and the second area 525 are folded around fold lines 527 and 528 extending in a length-wise direction of the first and second areas 521 and 525, respectively, such that the first and second areas 521 and 525 have a U-shaped cross-section. Then, the fifth area 526 is folded such that the fifth area 526 protrudes beyond the pin section 511. Then, the second area 525 is folded by 180 degrees around a fold line 529 towards the third area 523. Thereafter, the third area 523 is bent such that pillars 523*c* of the third area 523 are arcuate to thereby cause the third area 523 to be in the form of a barrel surrounding the inner shaft section 512.

By fabricating the press-fit type connector terminal 500 through the use of the metal plate 510 having a shape illustrated in FIGS. 35A and 35B, it is possible to perpendicularly insert the press-fit type connector terminal 500 into the through-hole 21 (see FIG. 6) formed through the printed circuit board 20, prevent the through-hole 21 from being whitened, prevent a plated surface of the through-hole 21 from being degraded, and enhancing reliability of the contact section 514.

Sixth Embodiment

Hereinbelow is explained the press-fit type connector terminal 600 in accordance with the sixth embodiment of the present invention, with reference to FIGS. 36 to 44B. The press-fit type connector terminal 600 is formed by bending a single metal plate 610 having elasticity, illustrated in FIGS. 44A and 44B.

The press-fit type connector terminal 600 includes a pin section 611 having a U-shaped cross-section, and a contact section 614 continuous to a front end of the pin section 611. The contact section 614 includes a plurality of "<"-shaped contact pieces 613 extending in parallel with an imaginary center line 614*c* extending in a length-wise direction L of the pin section 611, and outwardly protruding so as to surround the imaginary center line 614*c*.

A plurality of the contact pieces 613 is formed at both distal and proximal ends thereof with C-shaped binders 615 and 616 surrounding the imaginary center line 614*c*. The binder 615 situated at front ends of the contact pieces 613 is designed to include at a distal end thereof a tapered inclining section 602. The pin section 611 is formed in the vicinity of the contact section 614 in a length-wise direction L thereof with shoulders 603 protruding beyond an outer surface of the pin section 611.

Figure 36:
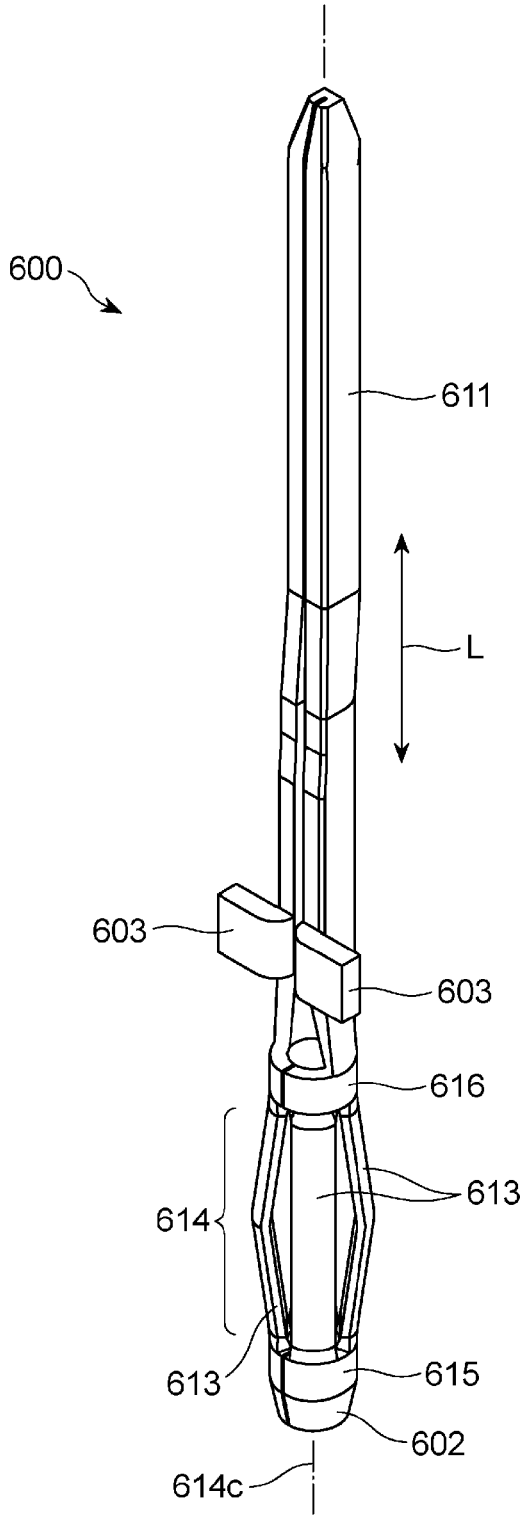
FIG. 36 is a perspective view of the press-fit type connector terminal in accordance with the sixth embodiment of the present invention.
Figure 37:
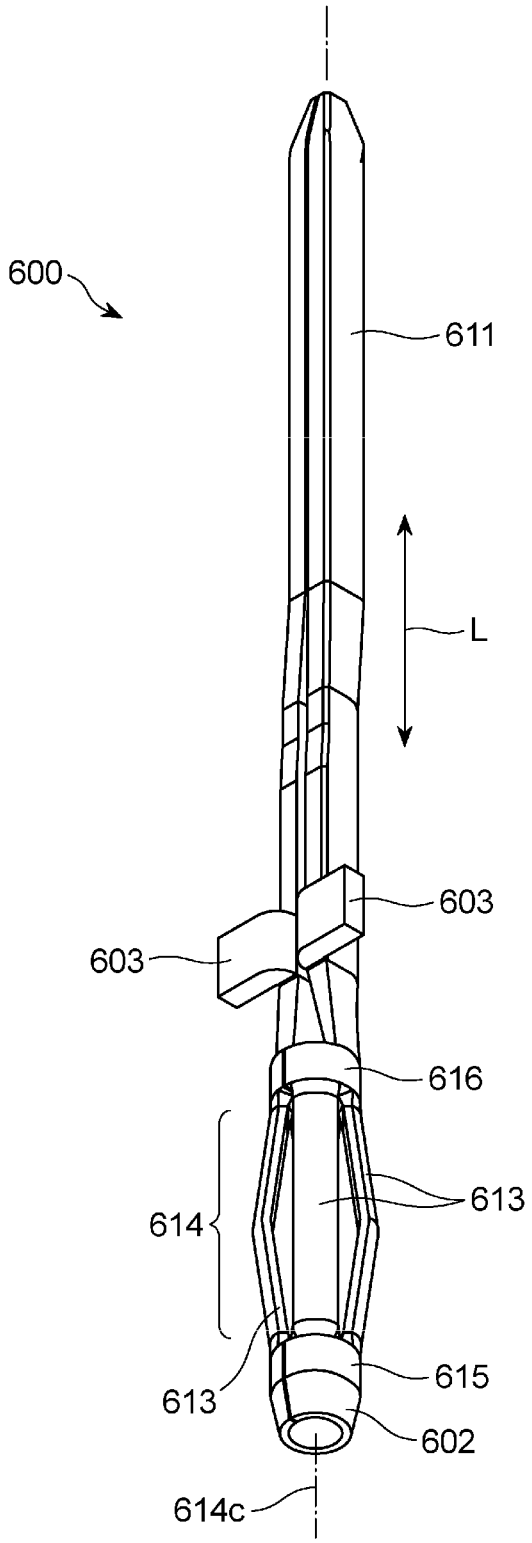
FIG. 37 is a perspective view of the press-fit type connector terminal illustrated in FIG. 36, viewing in a different angle from FIG. 36.
Figure 38:
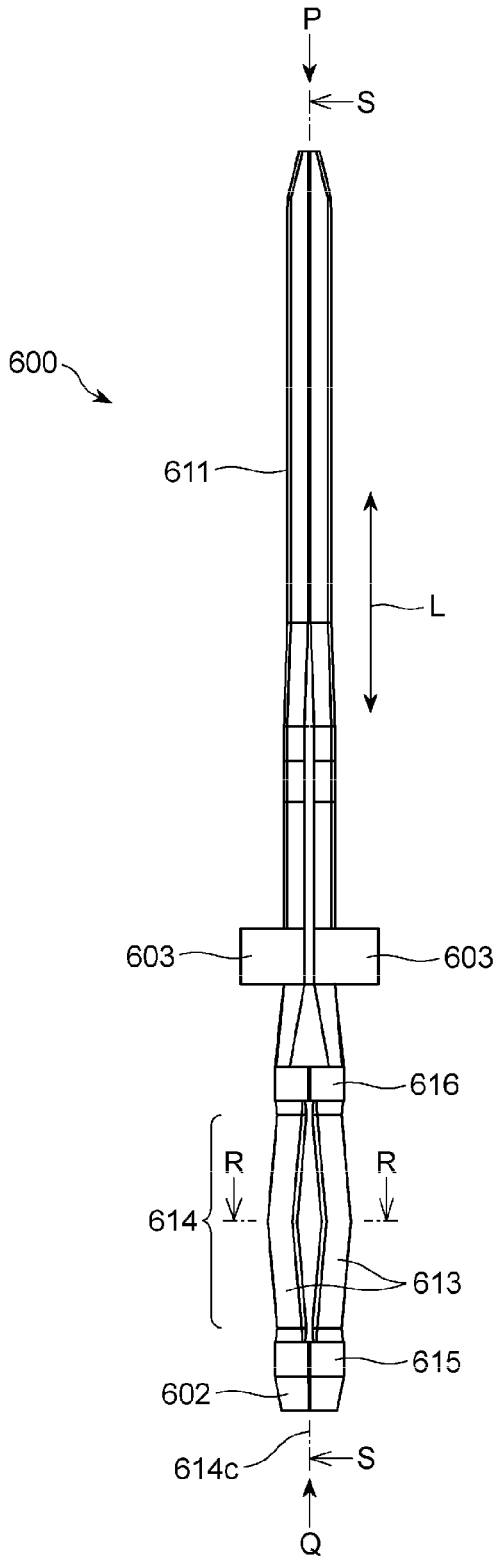
FIG. 38 is a front view of the press-fit type connector terminal illustrated in FIG. 36.
Figure 39:
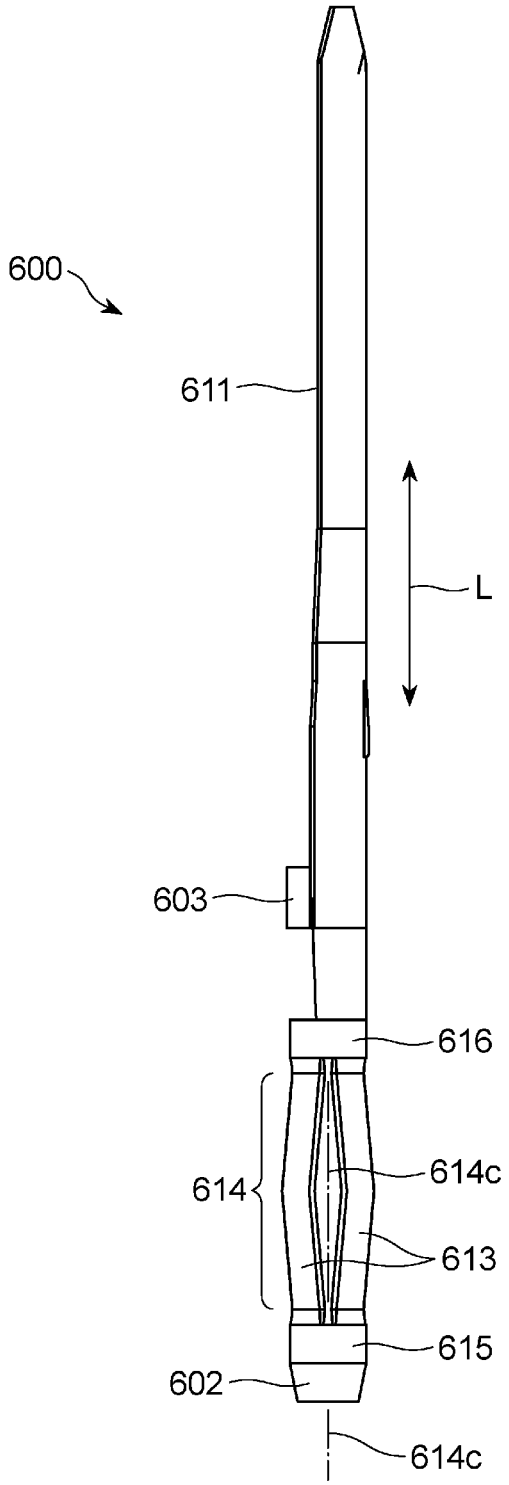
FIG. 39 is a right-side view of the press-fit type connector terminal illustrated in FIG. 38.
Figure 40:
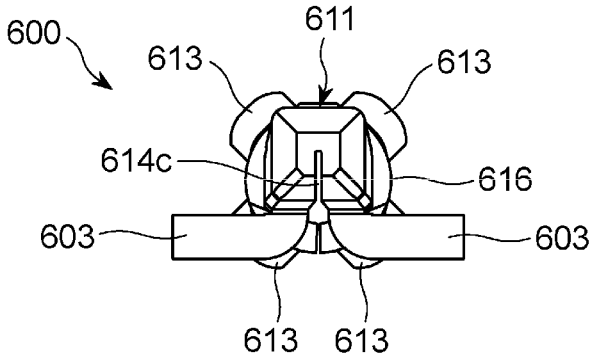
FIG. 40 is a view viewed in accordance with an arrow P shown in FIG. 38.
Figure 41:
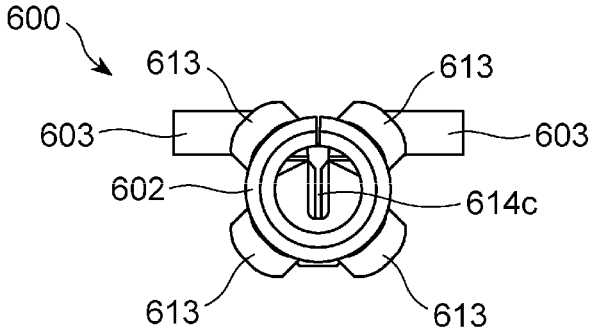
FIG. 41 is a view viewed in accordance with an arrow Q shown in FIG. 38.
Figure 42:
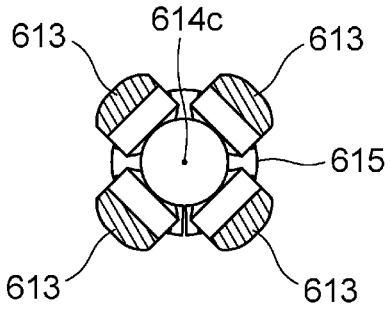
FIG. 42 is a cross-sectional view taken along the line R-R shown in FIG. 38.
Figure 43:
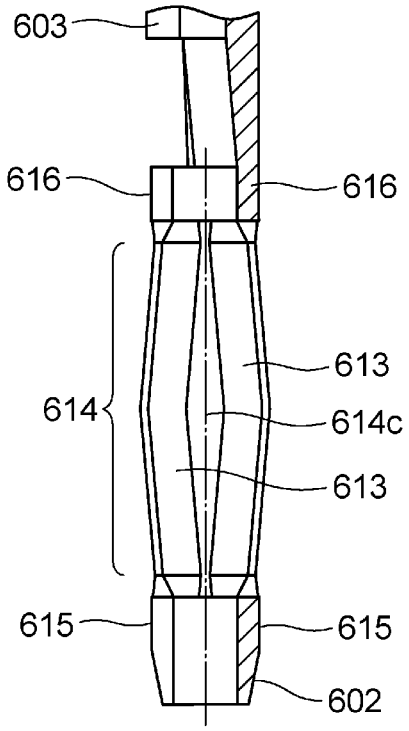
FIG. 43 is a partial cross-sectional view taken along the line S-S shown in FIG. 38.
Figure 44A:
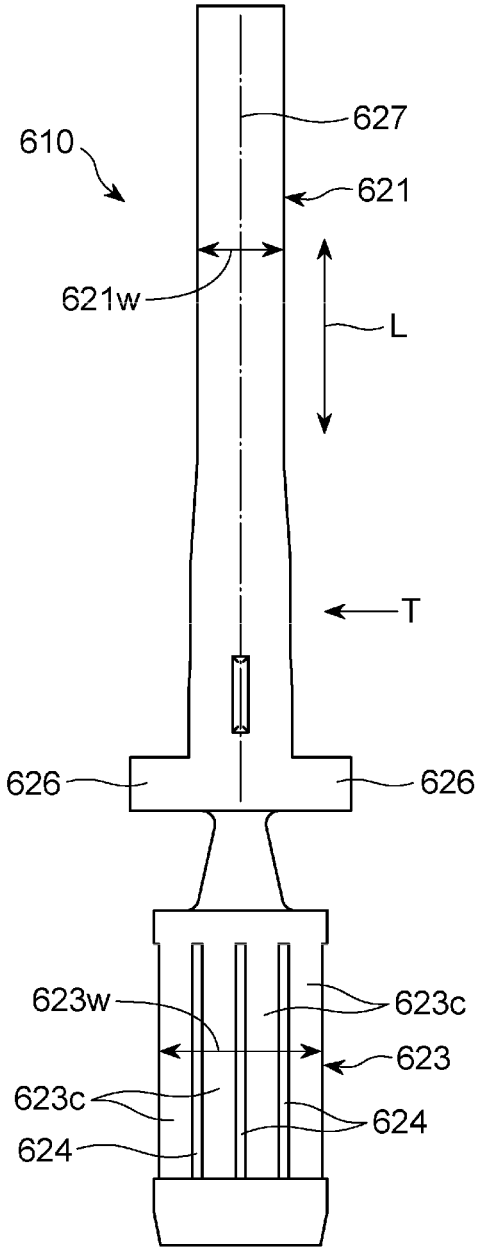
FIG. 44A is a view illustrating a developed metal plate from which the press-fit type connector terminal illustrated in FIG. 36 is fabricated.
Figure 44B:
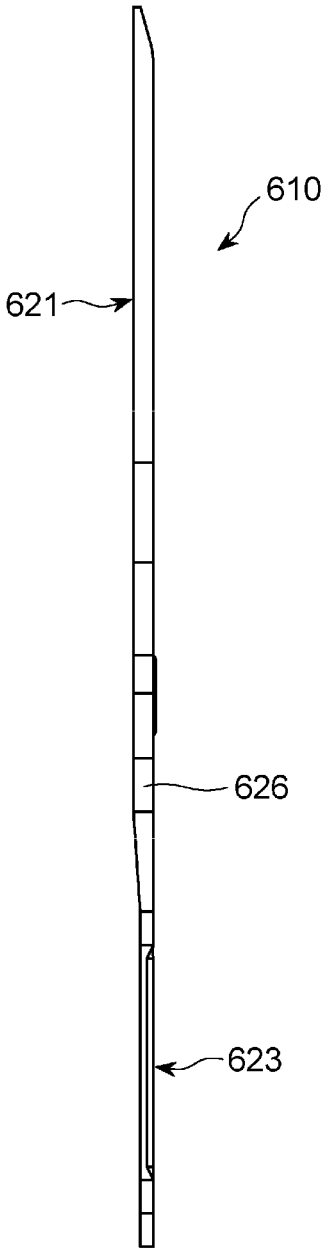
FIG. 44B is a view viewed in accordance with an arrow T shown in FIG. 44A.

The press-fit type connector terminal 600 illustrated in FIG. 36 is made from the metal plate 610 illustrated in FIGS. 44A and 44B. The metal plate 610 includes a band-shaped first area 621 for forming the pin section 611, a substantially rectangular third area 623 for forming the contact section 614, continuous to a front end of the first area 621, having a width 623*w* greater than a width 621*w* of the first area 621, and having a plurality of slits 624 and pillars 623*c* both extending in a length-wise direction L of the first area 621. The metal plate 610 further includes a fifth area 626 for forming the shoulders 603, continuous to the first area 621, and intersecting in T-shape with the first area 621.

The press-fit type connector terminal 600 illustrated in FIG. 36 is formed by pressing the metal plate 610 having a shape illustrated in FIGS. 44A and 44B, as follows.

First, the first area 621 is folded around a fold line 627 extending in a length-wise direction of the first areas 621 such that the first area 621 has a U-shaped cross-section. Then, the fifth area 626 is folded such that the fifth area 626 protrudes beyond the pin section 611. Thereafter, the third area 623 is bent such that pillars 623*c* of the third area 623 are "<"-shaped to thereby cause the third area 623 to be in the form of a barrel surrounding the imaginary center line 614*c*.

Figure 22:
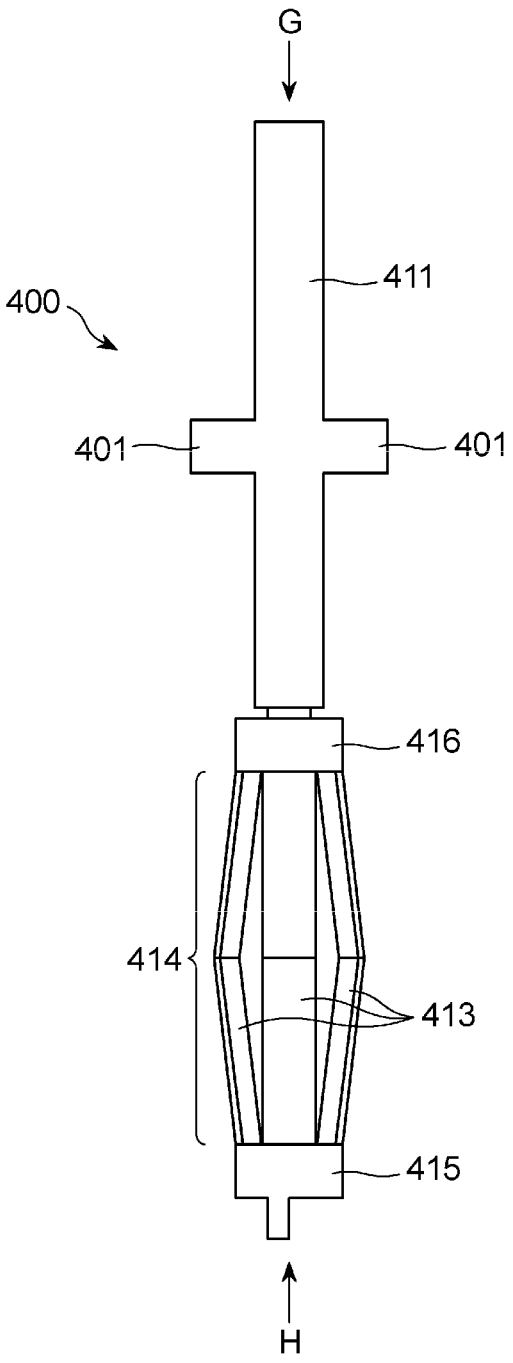
FIG. 22 is a front view of the press-fit type connector terminal illustrated in FIG. 21.
Figure 23:
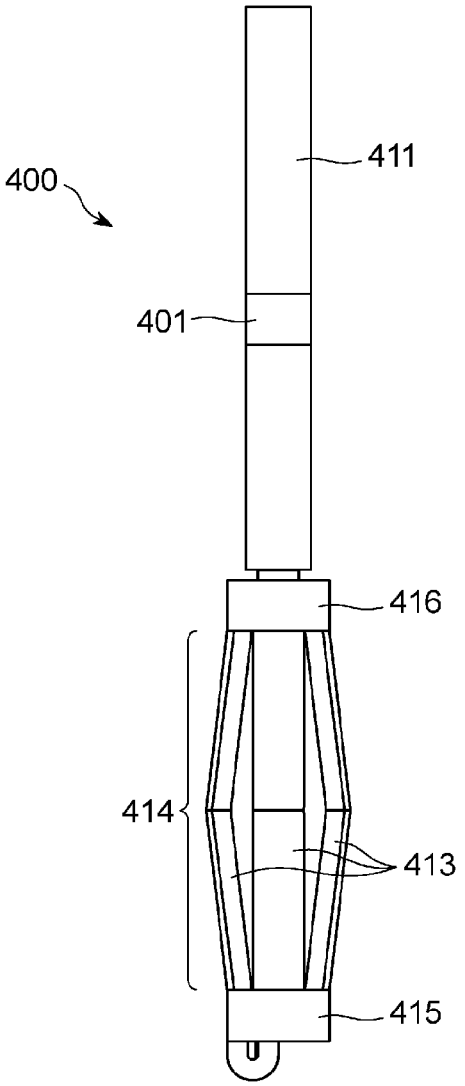
FIG. 23 is a right-side view of the press-fit type connector terminal illustrated in FIG. 21.
Figure 24:
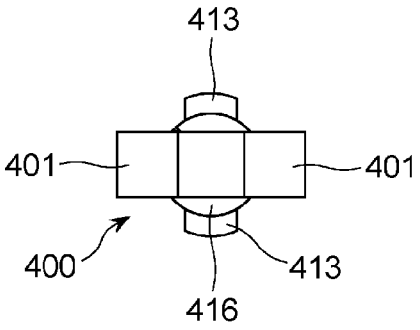
FIG. 24 is a view viewed in accordance with an arrow G shown in FIG. 22.
Figure 25:
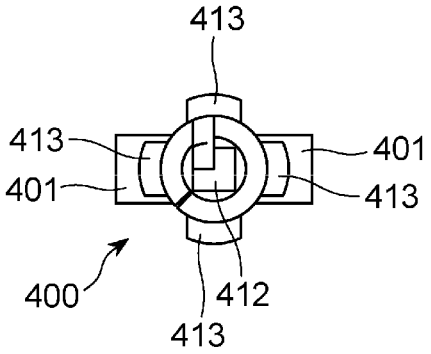
FIG. 25 is a view viewed in accordance with an arrow H shown in FIG. 22.

The press-fit type connector terminal 600 is used in the same way and has the same functions as the press-fit type connector terminal 200 illustrated in FIG. 9 and the press-fit type connector terminal 400 illustrated in FIG. 22, but is structurally different from the press-fit type connector terminals 200 and 400 in that the press-fit type connector terminal 600 does not include an inner shaft section. By designing the press-fit type connector terminal 600 not to include an inner shaft section, the metal plate 610 illustrated in FIGS. 44A and 44B can be designed not to include an area for forming an inner shaft section, and accordingly, a size of the metal plate 610 from which the press-fit type connector terminal 600 is fabricated can be reduced, and further, it is possible to lighten the press-fit type connector terminal 600.

Seventh Embodiment

Hereinbelow is explained the press-fit type connector terminal 700 in accordance with the seventh embodiment of the present invention, with reference to FIGS. 36 to 52B. The press-fit type connector terminal 700 is formed by bending a single metal plate 710 having elasticity, illustrated in FIGS. 52A and 52B.

As illustrated in FIGS. 45 to 51, the press-fit type connector terminal 700 includes a pin section 711 having a U-shaped cross-section, and a contact section 714 continuous to a front end of the pin section 711. The contact section 714 includes a contact piece 713 being in the form of a barrel surrounding an imaginary center line 714*c* extending in a length-wise direction L of the pin section 711, and a slit 701 extending on a surface of the contact piece 713 almost in parallel with the imaginary center line 714*c*. In the contact section 714 is located an inner shaft section 712 having a U-shaped cross-section, in continuation with the contact piece 713.

Figure 51:
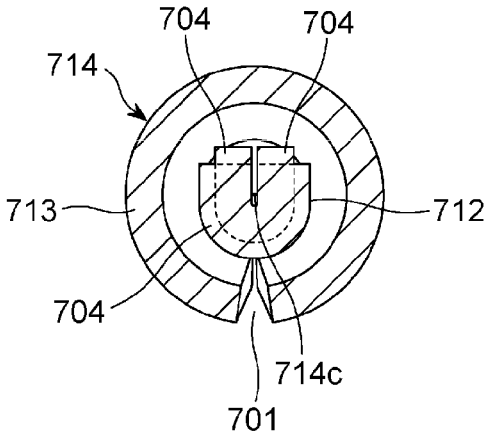
FIG. 51 is a cross-sectional view taken along the line W-W shown in FIG. 47.

The contact pieces 713 is formed at both distal and proximal ends thereof with C-shaped binders 615 and 616 surrounding the inner shaft section 712 substantially coaxial with the imaginary center line 714*c*. The binder 715 situated at a front end of the contact piece 713 is designed to include at a distal end thereof a tapered inclining section 702. The pin section 711 is formed in the vicinity of the contact section 714 in a length-wise direction L thereof with shoulders 703 protruding beyond outer surfaces of the pin section 711 and the contact section 714. As illustrated in FIG. 51, a plurality of protrusions 704 protrudes towards the contact piece 713 from an outer surface of the inner shaft section 712.

Figure 45:
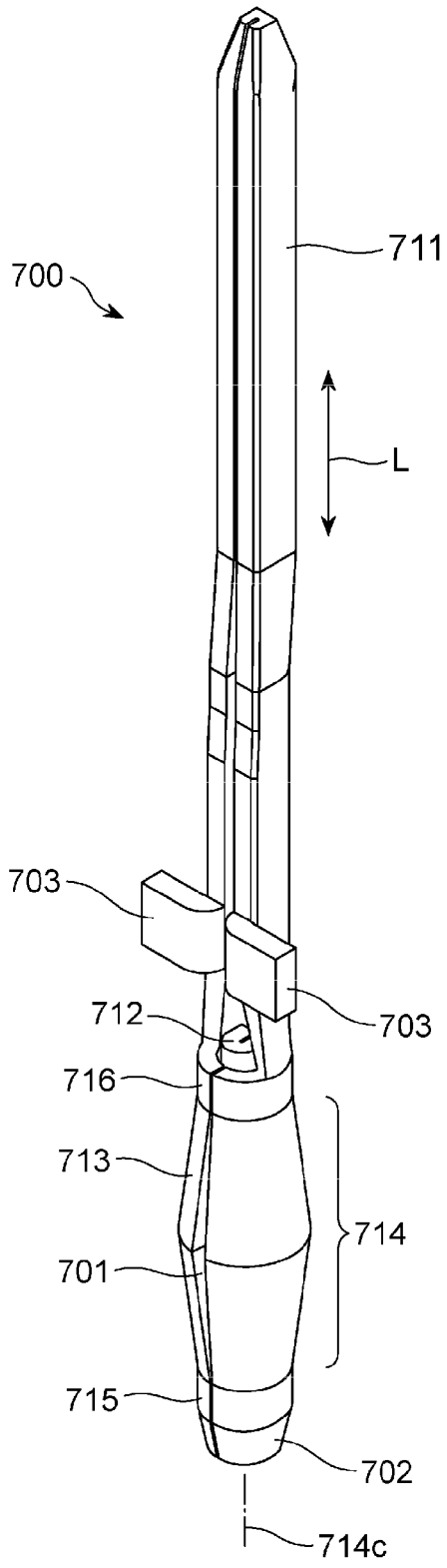
FIG. 45 is a perspective view of the press-fit type connector terminal in accordance with the seventh embodiment of the present invention.
Figure 46:
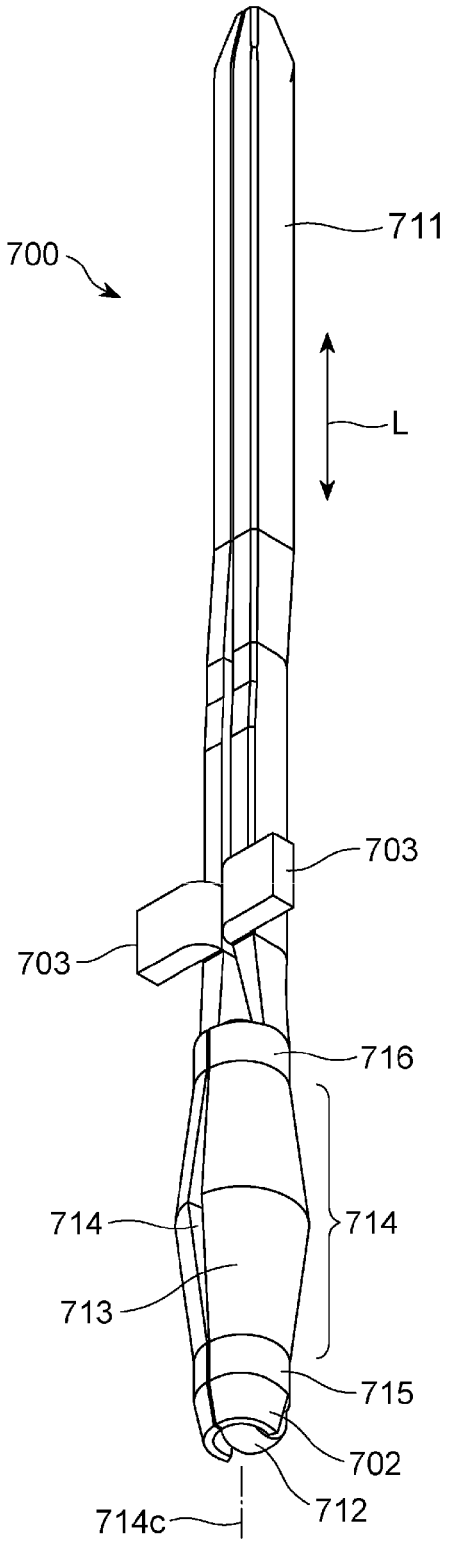
FIG. 46 is a perspective view of the press-fit type connector terminal illustrated in FIG. 45, viewing in a different angle from FIG. 45.
Figure 47:
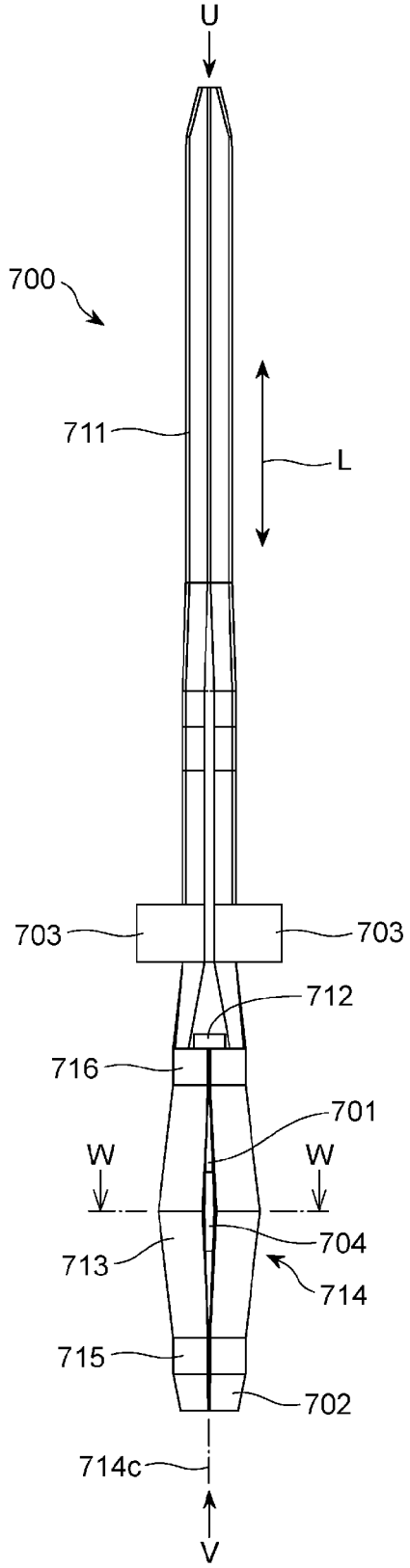
FIG. 47 is a front view of the press-fit type connector terminal illustrated in FIG. 45.
Figure 48:
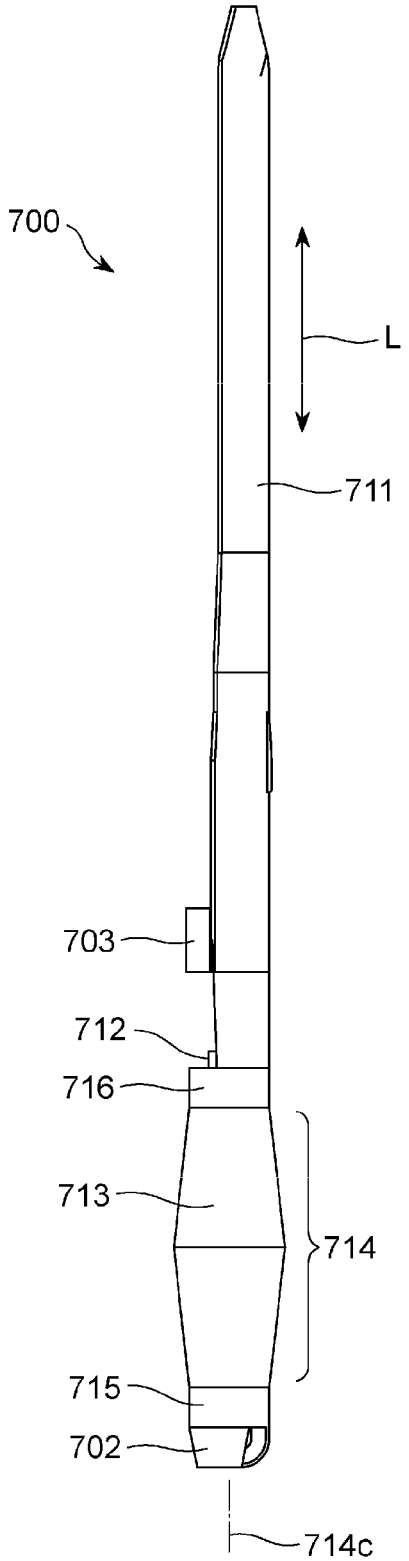
FIG. 48 is a right-side view of the press-fit type connector terminal illustrated in FIG. 47.
Figure 49:
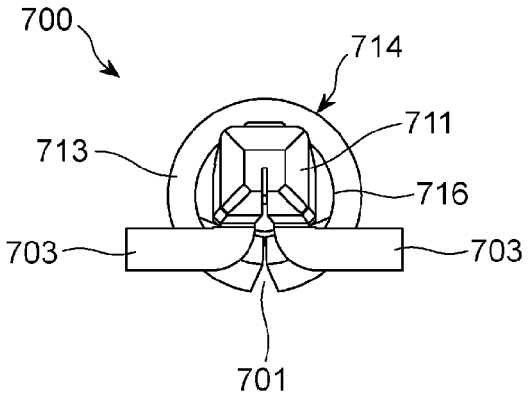
FIG. 49 is a view viewed in accordance with an arrow U shown in FIG. 47.
Figure 50:
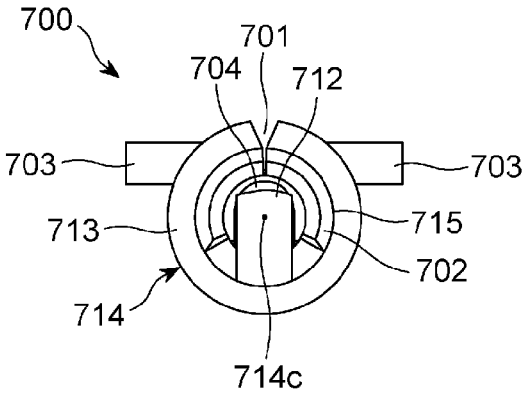
FIG. 50 is a view viewed in accordance with an arrow V shown in FIG. 47.
Figure 52A:
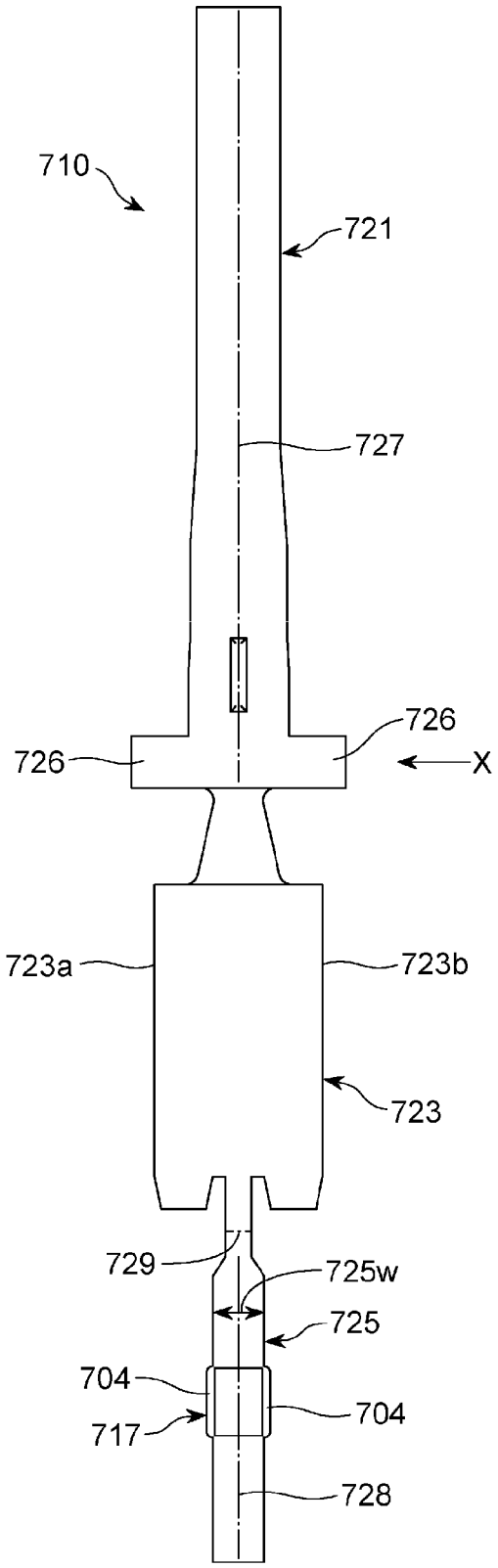
FIG. 52A is a view illustrating a developed metal plate from which the press-fit type connector terminal illustrated in FIG. 45 is fabricated.
Figure 52B:
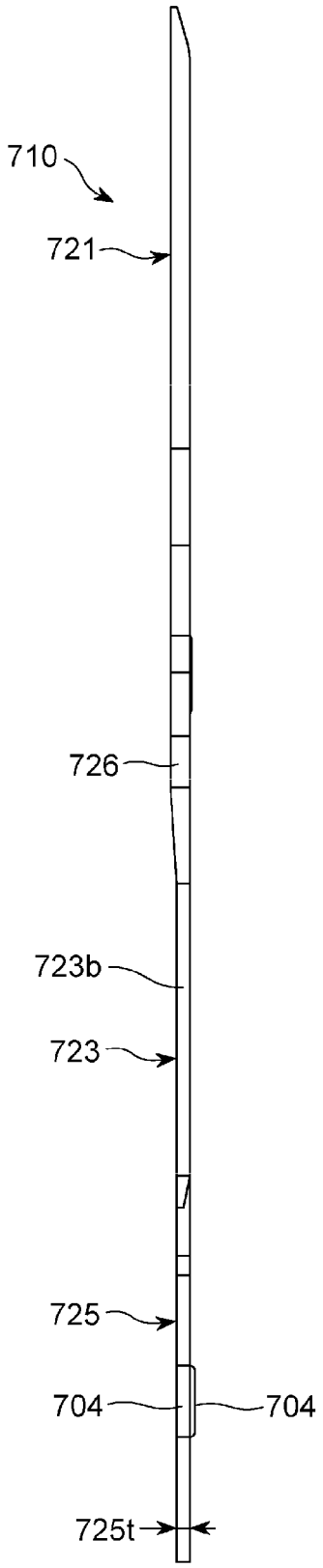
FIG. 52B is a view viewed in accordance with an arrow X shown in FIG. 52A.

The press-fit type connector terminal 700 illustrated in FIG. 45 is made from the metal plate 710 illustrated in FIGS. 52A and 52B. The metal plate 710 includes a band-shaped first area 721 for forming the pin section 711, a substantially rectangular third area 723 for forming the contact section 714, continuous to a front end of the first area 721, and having a width greater than a width of the first area 721, and a band-shaped second area 725 for forming the inner shaft section 712, continuous to a front end of the third area 723, and having a width smaller than a width of the third area 723. The metal plate 710 further includes a fifth area 726 for forming the shoulders 703, continuous to the first area 721, and intersecting in T-shape with the first area 721. The second area 725 is formed at a center thereof with a fourth area 717 for forming the protrusions 704. The fourth area 717 protrudes beyond the second area 725 in both a width-wise direction 725*w* and a thickness-wise direction 725*t* of the second area 725.

The press-fit type connector terminal 700 illustrated in FIG. 45 is formed by pressing the metal plate 710 having a shape illustrated in FIGS. 52A and 52B, as follows.

First, the first area 721 and the second area 725 are folded around fold lines 727 and 728 extending in a length-wise direction of the first and second areas 721 and 725 such that the first and second areas 721 and 725 have a U-shaped cross-section to thereby form the pin section 711 and the inner shaft section 712. Then, the fifth area 726 is folded such that the fifth area 726 protrudes beyond the pin section 711. Thereafter, the inner shaft section 712 made from the second area 715 is folded by 180 degrees around a fold line 729 towards the third area 723 to thereby cause the third area 723 to surround the inner shaft section 712 and to be in the form of a barrel having the slit 701 (see FIG. 45) located in facing relation with side edges 723*a* and 723*b* of the third area 723.

The press-fit type connector terminal 700 is used in the same way and has the same functions as the press-fit type connector terminal 400 illustrated in FIG. 21 and the press-fit type connector terminal 500 illustrated in FIG. 27, but is structurally different from the press-fit type connector terminals 400 and 500 in that the contact section 714 of the press-fit type connector terminal 700 includes the contact piece 713 having a continuous shape without cut-lines except the slit 701. By designing the press-fit type connector terminal 700 to include the contact piece 713, it is possible to enlarge an area in which the contact section 714 makes contact with a through-hole formed through a printed circuit board, ensuring enhancement in contact reliability of the contact section 714 with a through-hole.

A shape of the contact section 714 is not to be limited to a barrel. The contact section 714 may be designed to be in the form of a spindle outwardly protruding in a curved surface at a center in a length-wise direction of the imaginary center line 714*c*. Furthermore, the press-fit type connector terminal 700 may be designed not to include the inner shaft section 712.

The above-mentioned press-fit type connector terminals 100, 200, 300, 400, 500, 600 and 700 are just examples of the present invention. The scope of the present invention is not to be limited to those examples.

INDUSTRIAL APPLICABILITY

The press-fit type connector terminal in accordance with the present invention can be broadly employed, for instance, in fields of electric/electronic industry and automobile industry as a connector to be inserted into a through-hole formed through a printed circuit board.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-58817 filed on Feb. 28, 2012 including specification, claims, drawings and summary is incorporated herein by reference in its entirety.

What is claimed is:

1. A press-fit type connector terminal comprising:

a pin section having a U-shaped or quadrangular cross-section;

a contact section situated at a front end of said pin section; and

C-shaped binders, said contact section including a plurality of "<"-shaped or arcuate contact pieces having a longitudinal axis extending parallel to an imaginary center line extending parallel to a longitudinal axis of said pin section, and outwardly protruding so as to surround said imaginary center line, said C-shaped binders being arranged around distal and proximal ends of each of said contact piece so as to surround said imaginary center line, said connector terminal being comprised of a single bent metal plate having elasticity.

2. The press-fit type connector terminal as set forth in claim 1, further comprising an inner shaft section situated in said contact section and continuous with at least one of said pin section and said contact piece.

3. The press-fit type connector terminal as set forth in claim 1, wherein said contact pieces are equally spaced away from adjacent ones.

4. The press-fit type connector terminal as set forth in claim 2, wherein said inner shaft section is formed at an outer surface thereof with a protrusion protruding towards said contact piece.

5. The press-fit type connector terminal as set forth in claim 1, further comprising a tapered inclining section at a distal end of said binder situated at a distal end of said contact piece.

6. The press-fit type connector terminal as set forth in claim 1, further comprising at least one of a shoulder having a portion protruding beyond an outer surface of said pin section, and a flange having a portion having a diameter greater than an outer diameter of said pin section.

7. The press-fit type connector terminal as set forth in claim 2, wherein said metal plate includes:

a band-shaped first area for forming said pin section;

a band-shaped second area for forming said inner shaft section, said second area being continuous to a distal end of said first area and having a width smaller than the same of said first area;

a connection area continuous to a distal end of said second area and having a width smaller than the same of said second area; and a third area for forming said contact section, said third area including a plurality of slits extending parallel to a longitudinal axis of said second area, said third area being continuous to a distal end of said connection area and being in the substantially rectangular form having a width greater than the same of said second area.

8. The press-fit type connector terminal as set forth in claim 2, wherein said metal plate includes:

a band-shaped first area for forming said pin section;

a band-shaped second area for forming said inner shaft section, said second area being continuous to a distal end of said first area and having a width smaller than the same of said first area; and a third area for forming said contact section, said third area including a plurality of slits extending parallel to a longitudinal axis of said second area, said third area being continuous to a distal end of said second area and being in the substantially rectangular form having a width greater than the same of said second area.

9. The press-fit type connector terminal as set forth in claim 2, wherein said metal plate includes:

a band-shaped first area for forming said pin section;

a third area for forming said contact section, said third area including a plurality of slits extending parallel to a longitudinal axis of said first area, said third area being continuous to a distal end of said first area and being in the substantially rectangular form having a width greater than the same of said first area; and a band-shaped second area for forming said inner shaft section, said second area being continuous to a distal end of said third area and having a width smaller than the same of said third area.

10. The press-fit type connector terminal as set forth in claim 7, wherein at least a portion of said first area has a thickness greater than a thickness of said third area.

11. The press-fit type connector terminal as set forth in claim 7, wherein said second area includes a fourth area for forming a protrusion protruding both in width-wise and thickness-wise directions of said second area.

12. The press-fit type connector terminal as set forth in claim 1, wherein said metal plate includes:

a band-shaped first area for forming said pin section; and a third area for forming said contact section, said third area including a plurality of slits extending parallel to a longitudinal axis of said first area, said third area being continuous to a distal end of said first area and being in the substantially rectangular form having a width greater than the same of said first area.

* * * * *